US007090475B2

(12) United States Patent
Shrive

(10) Patent No.: US 7,090,475 B2
(45) Date of Patent: Aug. 15, 2006

(54) HYDRAULIC CONTROL CIRCUIT FOR A HYDRAULIC ENGINE WITH AT LEAST TWO SPEEDS

(75) Inventor: Chris Shrive, Dunfermline (GB)

(73) Assignee: Mannesmann Rexroth AG, Lohr am Main (DE)

( * ) Notice: Subject to any disclaimer, the term of this patent is extended or adjusted under 35 U.S.C. 154(b) by 0 days.

(21) Appl. No.: 10/203,625

(22) PCT Filed: Feb. 15, 2001

(86) PCT No.: PCT/EP01/01702

§ 371 (c)(1),
(2), (4) Date: Oct. 16, 2002

(87) PCT Pub. No.: WO01/61186

PCT Pub. Date: Aug. 23, 2001

(65) Prior Publication Data

US 2003/0167770 A1 Sep. 11, 2003

(30) Foreign Application Priority Data

Feb. 17, 2000 (DE) ..... 100 07 155
Aug. 23, 2000 (DE) ..... 100 41 435

(51) Int. Cl.
*F04B 23/04* (2006.01)

(52) U.S. Cl. ..... 417/426; 417/286; 417/427; 417/428; 417/429; 60/425; 91/519; 91/489; 91/492

(58) Field of Classification Search ..... 417/286, 417/426, 427, 428, 429; 60/425 X; 91/519, 91/489, 492
See application file for complete search history.

(56) References Cited

U.S. PATENT DOCUMENTS 4,051,868 A * 10/1977 Andersen ..... 137/596.13
4,404,896 A * 9/1983 Allart et al. ..... 91/491

(Continued)

FOREIGN PATENT DOCUMENTS

DE 42 06 729 9/1992

(Continued)

*Primary Examiner*—Charles G. Freay
*Assistant Examiner*—Emmanuel Sayoc
(74) *Attorney, Agent, or Firm*—Oblon, Spivak, McClelland, Maier & Neustadt, P.C.

(57) ABSTRACT

A hydraulic control circuit for a radial piston engine with two speeds. The changeover between the speeds takes place through the alteration of the absorption volume, the delivery side being connected to the discharge side with a bypass connection by a valve arrangement for a selected number of engine pistons. The control circuit provides a space-saving way of ensuring that the changeover between speeds occurs smoothly and in such a manner to preserve the individual components as far as possible. To this end, at least one intermediate switching position, in which the delivery side is throttled to the discharge side, i.e. connected by a diaphragm-type arrangement, is provided in front of valve arrangement between the two end switching positions. The valve arrangement is preferably driven such that a valve body can be moved through the intermediate switching position at a controlled speed.

13 Claims, 15 Drawing Sheets

U.S. PATENT DOCUMENTS

| | | | | | |
|---|---|---|---|---|---|
| 4,538,505 | A | * | 9/1985 | Morillon | 91/518 |
| 4,543,786 | A | * | 10/1985 | Shuler | 60/435 |
| 4,724,742 | A | | 2/1988 | Bigo et al. | |
| 5,001,964 | A | * | 3/1991 | Allart et al. | 91/519 |
| 5,220,790 | A | * | 6/1993 | Allart et al. | 60/435 |
| 5,435,135 | A | | 7/1995 | Lallier et al. | |
| 5,857,330 | A | * | 1/1999 | Ishizaki et al. | 60/426 |
| 6,007,163 | A | * | 12/1999 | Sawada | 303/122.09 |
| 6,099,273 | A | * | 8/2000 | Allart et al. | 417/491 |
| 6,318,235 | B1 | * | 11/2001 | Allart et al. | 91/491 |
| 6,422,804 | B1 | * | 7/2002 | Gitter | 414/695.5 |
| 6,609,368 | B1 | * | 8/2003 | Dvorak et al. | 60/425 |
| 6,675,575 | B1 | * | 1/2004 | Cunningham | 60/425 |

FOREIGN PATENT DOCUMENTS

| | | |
|---|---|---|
| EP | 0 872 637 | 10/1998 |
| EP | 0 921 309 | 6/1999 |
| EP | 1 058 002 | 12/2000 |
| WO | WO 01/02205 A1 * | 1/2001 |

* cited by examiner

164'
167'
165'
162'
X
B
A
122
120
136
134
130-A
130
138
130-B
124
160
144
164
162
150
PV
164''
162''
C
B
A
T
Pv

HYDRAULIC CONTROL CIRCUIT FOR A HYDRAULIC ENGINE WITH AT LEAST TWO SPEEDS

The invention relates to a hydraulic control circuit for a hydraulic motor having at least two speeds.

Hydraulic motors that are fundamentally suitable for use of the invention are multi-stroke axial and radial piston motors, for example, hydraulic motors according to the planetary wheel principle, i.e. so-called gerotors, or piston motors with stepped pistons. The methods of construction of these hydraulic motors are generally known. Merely for the sake of completeness, reference is made to Chapter 5 "Hydromotoren" [Hydraulic Motors] in the teaching and informational manual "DER HYDRAULIK TRAINER—Band 1/Grundlagen und Komponenten der Fluidtechnik/Hydraulik" [THE HYDRAULICS TRAINER—Volume 1/Fundamentals and Components of Fluid Technology/Hydraulics], 2$^{nd}$ edition 1991.

Hydraulic motors with stepped pistons are described, for example, in the Japanese disclosure document 48-40007, in DE 37 23 988 A1, and in DE 40 37 455 C1. While in the case of the hydraulic motor shown in the Japanese disclosure document 48-40007, with radially directed pistons, the application of pressure takes place from the outside, it occurs from the inside in the case of DE 40 37 455 C1. The absorption volume and therefore the torque and the speed of rotation of the hydraulic motor known from DE 40 37 455 C1 are switched in that separate control channels are provided for the individual piston and ring spaces, i.e. for the individual working chambers, and that these working chambers are controlled separately. Either only the ring spaces, or only the piston spaces, or both working chamber groups jointly, can be impacted with pressure medium, in order to graduate the torque. The working chambers that are neutralized in this manner, in each instance, are therefore short-circuited.

The controls for switching the speed of rotation for these hydraulic motors then have in common that the absorption volume of the motor can be switched by means of a valve arrangement, in that the absorption volumes of selected working chambers, i.e. the motor chambers that perform the work, such as a piston group that is to be turned on or shut off, for example, are selectively neutralized, and this is generally done by short-circuiting the intake and outlet side of the motor chambers in question.

In the following, the problems that occur in the utilization case of a radial piston motor according to the multi-stroke principle will be described in greater detail:

In the case of radial piston motors according to the multi-stroke principle, the radially arranged pistons are generally supported on a stroke cam, by way of a roller device. In this connection, the cylinder space is regularly supplied with pressure fluid by way of axial bores, and each motor piston is loaded with fluid or relieved, respectively, per shaft rotation, as often as corresponds to the number of notches on the stroke cam. In this connection, the torque that is created by the cam shape of the stroke ring is transferred to a power take-off shaft by the piston group, which is housed in a rotor part, by means of a gear.

In certain versions of such radial piston motors, the absorption volume can be cut in half in that a valve in the hydraulic control is used to ensure that only half of the motor pistons are supplied with pressure fluid during the working stroke. The remaining motor pistons are connected with the outlet side of the motor, causing the radial piston motor to run at twice the speed of rotation but only half the torque when it is switched in this state.

A hydraulic control circuit, in a use for radial piston motors, is known, for example, from U.S. Pat. No. 4,724,742. In this case, the valve arrangement has a piston slide that can be moved counter to the force of a pull-back spring, by means of a control pressure that acts in the opposite direction, said slide being housed either in the standing part, i.e. in the motor housing, or in the rotating part, i.e. in the rotor. In this connection, special measures of circuit technology are taken to ensure that the two speeds can be stabilized as uniformly as possible.

However, it has been shown that the lifetime of such radial piston motors, which are equipped with the option of a changeable absorption volume, for example one that can be cut in half, is noticeably reduced, which is attributable to increased wear in the region of the cam flanks and rollers, on the one hand, as well as cavitation-related wear phenomena in the region of the motor pistons, on the other hand.

The invention is therefore based on the task of further developing the hydraulic control circuit for a radial piston motor having two speeds, in such a way that it is possible, with little effort in terms of circuit technology and device technology, to increase the lifetime of such radial piston motors, which can be switched with regard to speed, and, at the same time, to expand the area of use of these motors, particularly to include the sector of mobile hydraulics.

According to one aspect of the invention, the valve arrangement is restructured in such a way that switching between the different motor speeds takes place by way of at least one intermediate switching position, in which the intake side is connected, in terms of flow medium, with the outlet side of the working chamber group, i.e. motor piston group, by way of an orifice arrangement, thereby making it possible to effectively counteract the occurrence of pressure peaks in the control circuit and in the region of the motor chambers, i.e. motor pistons, during the switching process, using simple means. Therefore, by effectively avoiding a pressure increase in the main circuit, the hydraulic motor, for example the radial piston motor, is not abruptly accelerated or braked, thereby not only significantly reducing the stresses on the motor components, and particularly on the motor components that participate in the rolling movement, but also making the forces that are transferred to the subsequent drive train more uniform. The movements controlled by the hydraulic motor are performed in a significantly gentler manner on the basis of the structure of the control circuit according to the invention, and this has the particular advantage that such hydraulic motors, which can be switched in terms of speed of rotation, can be used with improved convenience and greater operational reliability in mobile hydraulics, for example for a traveling mechanism or for a lifting unit. The operator can perform the switching process between the speeds without jerky movements, thereby eliminating abrupt acceleration or braking of the vehicle, with the risk of instability of movement or loss of ground contact of individual wheels. If a load is moved using the hydraulic motor, switching also takes place without jerky movements, so that sudden acceleration of moving parts, such as the load and the components that carry it are avoided, thereby benefiting the functional reliability and, in particular, the operational reliability of the mobile hydraulic vehicle or device. Even loads that have not been specially secured can be safely moved in this manner, with stepped speeds. In this connection, there is the additional advantage that at the same time, damage to the pump or to the valves is avoided.

Optimization of the pressure build-up in the region of the motor piston group, which is under critical stress during the switching process, is possible, according to one aspect of the invention, in particularly effective manner, if care is taken to ensure that a valve body of the valve arrangement is moved at a controlled speed beyond this intermediate switching position.

A particular advantage of these measures according to one aspect of the invention is that the hydraulic control circuit only has to be modified slightly in order to achieve the effects described above. For example, the orifice arrangement can be made available in simple manner, by means of a suitable control edge geometry of a conventional control slide, thereby opening up the possibility of retrofitting radial piston motors that are already in operation with the hydraulic control circuit according to the invention. In this connection, it has furthermore been shown that not only are the critical mechanical stresses on the motor components significantly reduced by means of restructuring the hydraulic control circuit according to the invention, but at the same time, cavitation-related wear in the region of the motor pistons and their connectors is significantly reduced, thereby resulting in the additional advantage that conventional measures for cavitation protection, such as commercially available check valves, can be used.

An optimal adaptation of the control circuit to the design of a radial piston motor, particularly a radial piston motor according to the multi-stroke principle, is one aspect of the invention.

A particularly precise control of the valve arrangement results from a further aspect of the invention. The initial pressure of an infinitely adjustable pressure valve can be controlled along a predetermined profile, with sufficient speed, so that the intermediate switching position of the valve arrangement occurs under precise control in terms of time, and thereby with the assurance of an optimal pressure build-up in the region of the motor piston group that is critical in each instance.

An alternative for controlling the valve arrangement, simplified in terms of its structure, is another aspect of the invention.

Advantageous variants for the production of a control pressure downstream from an orifice are another aspect of the invention.

If the orifice is integrated into a directional valve, as in claim 7, there is a cost advantage, because a conventional valve can be used, and furthermore, there is the advantageous effect that the orifice is taken out of the supply line after the directional valve has been switched. In this way, the occurrence of cavitation due to a temporary under-supply of certain segments of the hydraulic motor, particularly the occurrence of impermissibly low suction pressures in the deactivated but mechanically compulsorily coupled motor working chambers, can be effectively countered in that additional flow medium, i.e. anti-cavitation flow medium, i.e. anti-cavitation pressure, is fed into the control pressure line. Preferably, the center position of the directional valve is passed through at a reduced speed, so that the desired pressure increase in the control pressure circuit can be achieved using simple measures of control technology.

A comparable effect that avoids the risk of the occurrence of cavitation can be achieved by including a sequential control valve according to another apsect of the invention.

It has been shown that a slow and preferably ramp-like increase in the control pressure, according another aspect of the invention, easily yields sufficient results in control of the valve arrangement.

In addition, the switching time can be optimized with the further development of another apsect of the invention. Preferably, control of the infinitely adjustable pressure valve or the directional valve according to one aspect of the invention takes place using a programmed signal with which the pressure build-up in the critical supply circuit for the motor pistons, i.e. the motor working chambers, in each instance, is precisely predetermined in terms of time. In other words, the valve body of the valve arrangement controlled in this manner is moved between the two switching positions in accordance with a predetermined path/time diagram, so that it passes through at least one intermediate switching position at a predetermined speed profile.

A particularly simple structure of the valve arrangement is another aspect of the invention. This design makes do with a simple valve slide that can be moved counter to a spring, which slide only needs to be modified in the region of the control edges, as compared with a conventional switching valve piston, in order to assure its function according to the invention. The orifice arrangement is preferably formed by measurement grooves in the region of the control edges of the valve slide, thereby resulting in the advantage that not even the axial construction length of the valve arrangement has to be extended as compared with a conventional directional valve slide.

As already mentioned earlier, restructuring of the control circuit according to the invention creates advantageous prerequisites for minimizing cavitation-related wear of the motor components. The further development of one aspect of the invention effectively ensures that the suction side(s) of the motor pistons, i.e. motor working chambers of the operationally deactivated piston group(s), i.e. working chamber group(s), is/are supplied with a sufficient amount of flow medium in this critical state, in which they are moved at a higher speed. Not only the risk of cavitation, but also the occurrence of an increased noise level, are counteracted in this way. According to the further development of one aspect of the invention, the suction pressure of the motor is actually "pre-stressed" on the order of the control pressure, thereby additionally increasing the security against cavitation.

Since the measures according to one aspect of the invention for restructuring the switching valve arrangement are essentially limited to the control edges, it is easily possible to integrate the cavitation prevention valve, which is structured as a check valve, into the valve slide, in an advantageous further development according to nother aspect of the invention, thereby resulting in additional space savings.

The structure of the valve arrangement according to another aspect of the invention, as described above, is preferably used if the radial piston motor has a preferred running direction. If this running direction is reversed, the infinitely adjustable 3/2-way valve is on the outlet side of the piston group that is shut off, in terms of torque, with the result that this piston group is impacted with working pressure, i.e. high pressure, in the intake and the outlet, and this can lead to greater friction losses and therefore to a reduction in the output torque.

The further development of the hydraulic control circuit according to another aspect of the invention solves these problems and ensures identical advantages in both directions of rotation.

In this connection, the valve arrangement can still be structured in a simple manner, and accordingly, it can be easily integrated into corresponding components of the radial piston motor, i.e. either into the motor housing or into the housing of the rotor. Therefore, the above explanations concerning the further developments according to another aspect of the invention also apply to this variant.

Again, the further development of another aspect of the invention effectively ensures that the deactivated motor piston group, i.e. working chamber group, is not subject to an under-supply of flow medium in high-speed operation of the radial piston motor, so that cavitation-related wear phenomena are minimized.

The further development according to another aspect of the invention makes it possible to implement the combined impact protection and cavitation protection in extremely space-saving manner.

In the following, several exemplary embodiments of the invention will be explained in greater detail, using schematic drawings, with reference being made to use of the switching arrangement for a radial piston motor according to the multi-stroke principle, merely as an example. The figures show:

Figure 1:
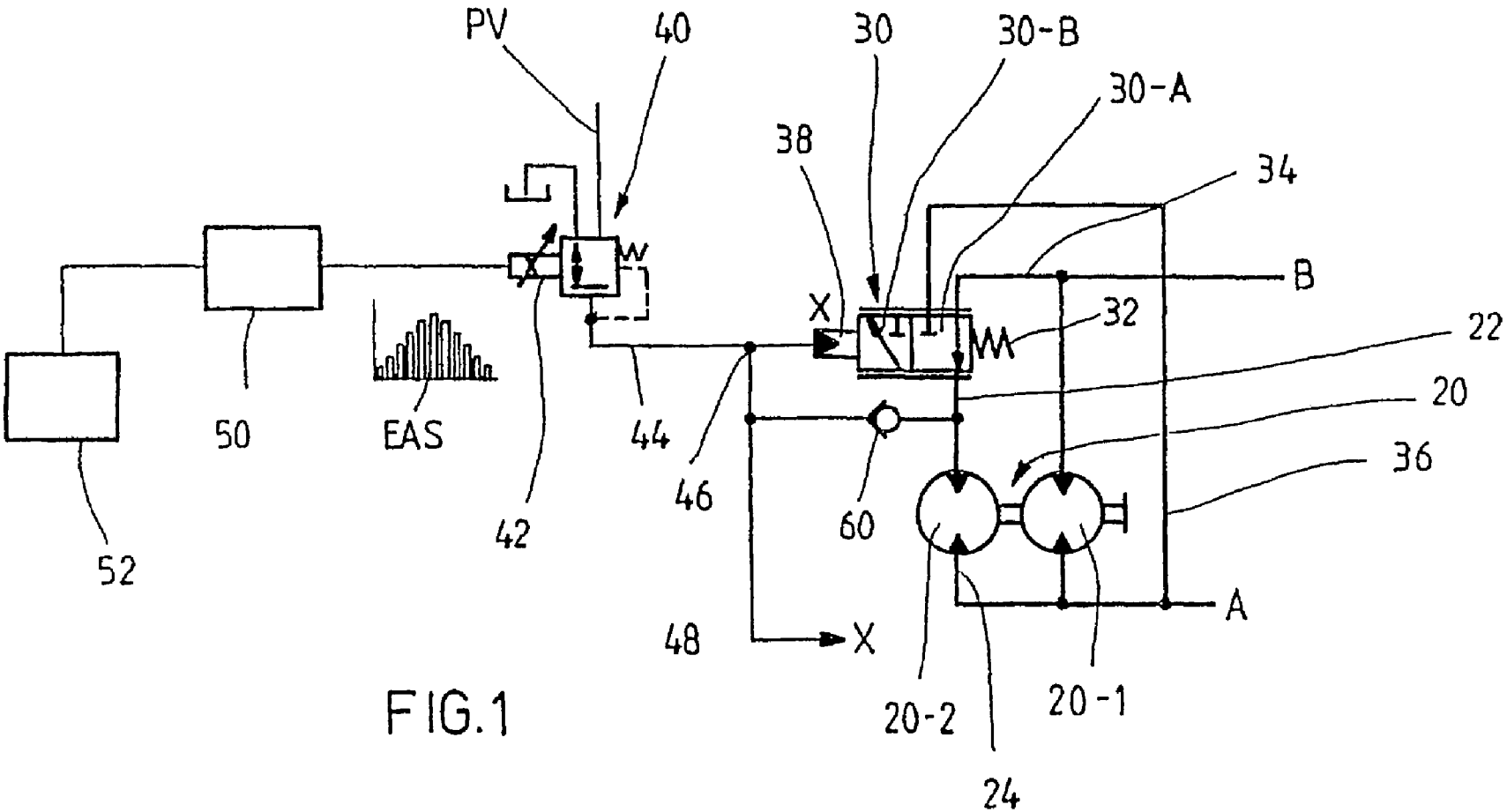
FIG. 1 shows a hydraulic circuit diagram of a first embodiment of the hydraulic control circuit for a radial piston motor having two speeds.

FIG. 1 shows a first embodiment of a hydraulic control circuit for a radial piston motor designated with the reference symbol 20, which has two piston groups 20-1 and 20-2, indicated schematically, of which motor piston group 20-2 can be selectively shut off in order to reduce the absorption volume, for example to cut it in half. The working pressure side, i.e. intake side of the radial piston motor 20 having two speeds is indicated as "B," and the outlet side as "A."

The radial piston motor, which is not shown in great detail, is structured according to the so-called "multi-stroke principle," in which the radially arranged pistons are supported on a stroke cam by way of rollers. The cylinder spaces of the individual pistons are supplied with pressure fluid by way of axial bores, where each piston is impacted with pressure fluid, or relieved, as many times per shaft rotation as corresponds to the number of notches in the stroke cam. The torque that results from the curved shape of the stroke ring is preferably transferred to a power take-off shaft by the rotor/piston group, by means of a gear.

For the switching process, a valve arrangement is provided in the region of the intake "B," i.e. in a line branch 34 for the piston group 20-2, in the form of an infinitely adjustable 3/2-way valve 30 that has two end switching positions 30-A and 30-B. A pull-back spring 32 presses the valve body, preferably a piston slide, into the switching position 20-A as indicated, in which the intake B is switched through to the piston group 20-2 via line segments 34 and 22. In this operational state, the two piston groups 20-2 and 20-1 are equally supplied with hydraulic fluid, so that the radial piston motor works at a predetermined first speed and at a predetermined first torque.

In the second end switching position 30-B, the line segment 34 of the valve 30 is closed. At the same time, in the switching position 30-B, the valve 30 short-circuits the intake 22 of the motor piston group 20-2 with its outlet side 24, where this takes place via a bridging line 36.

If a short-circuit of the intake side 22 and the outlet side 24 is therefore present for the piston group 20-2, only the pistons of the piston group 20-1 are still being supplied with pressure fluid during the working stroke, causing the motor to run at an increased speed of rotation, generally twice the speed, but at a reduced torque, generally half the torque, in this state.

The radial piston motor shown in FIG. 1 is also able to work in the opposite direction of rotation, where in this case, the connectors "A" and "B" are interchanged. In this direction of rotation, the connectors 22 and 24 of the piston group 20-2 are again short-circuited in the switching position 30-B of the valve 30 so that this piston group cannot contribute to increasing the torque. However, these connectors are at working pressure level, so that higher energy losses occur with this direction of rotation, such as a temperature increase of the pressure fluid and friction losses.

Such radial piston motors are increasingly being used in the sector of mobile hydraulics, where it is often necessary to switch the speed while under load. The following gives a detailed description of the measures taken in the sector of the hydraulic control circuit in order to carry out this switch in a gentle and non-abrupt manner, i.e. in such a manner that a pleasant driving feeling is obtained, on the one hand, and that the components of the radial piston motor and the hydraulic control circuit are protected against stress that promotes wear, on the other hand.

As already mentioned above, the valve 30 is structured as an infinitely adjustable 3/2-way valve, i.e. as a valve that has at least one intermediate switching position between the two end switching positions 30-A and 30-B, in which the line segments 34 and 22 that lie in the intake of the piston group 20-2 are connected with one another by way of an orifice arrangement. This intermediate switching position is explained in greater detail below, making reference to FIG. 3*ff*. The deciding factor is that the process of passing through this intermediate switching position is utilized to even out pressure peaks in the line segments 22, 24 and 34, 36, and thereby to avoid uncontrolled torque variations and/or speed variations at the power take-off shaft of the radial piston motor, which, in the final analysis, would result in impairment of the driving behavior of a vehicle equipped with such a motor.

In order to be able to pass through the intermediate switching position at a controlled speed and therefore at a controlled pressure build-up and reduction in the line segments 22, 24 and 34, 36, the control pressure X that is applied to the control connector 36 of the directional valve 30 is controlled, i.e. regulated as explained below:

The control pressure X is the starting pressure of an infinitely adjustable pressure valve 40, with which a supply pressure PV is preferably adjusted, i.e. regulated to the value "X" by means of electrical control at the signal connector 42. A branching of a control pressure line 44 into a control pressure branch line 48, which leads to additional motors or motor piston groups, takes place at the point 46.

Control of the infinitely adjustable pressure valve 40 takes place electrically in the embodiment according to FIG. 1, in that electronic output signals of a suitable control electronics device 50 are applied to the control connector 42, preferably under program control. The control electronics device 50 is supplied by a voltage source 52, for example a battery.

From the above description, it is clear that the control slide of the 3/2-way valve 30 is moved from one end switching position into the other, i.e. passing through the intermediate switching position, controlled in predetermined manner, on the basis of the control that is provided, i.e. by means of suitable control of the control signal X, so that pressure changes in the line segments 22, 24, 34, and 36 also occur in controlled and monitored manner. In this connection, the control can take place by program control, for example, in that the path/time diagram of the movement of the control slide varies as a function of the switching direction (switching on or off) of the piston group 20-2, making it possible to maximize the switching speed at a predetermined smoothing of the pressure peaks. Equally, control of the valve 30 according to the invention offers the possibility of selecting the time progression of the control signal at the control connector 42 in such a way that it is optimally adapted to the direction of rotation of the radial piston motor.

On the basis of the structure of the radial piston motor as described initially, it is clear that all the pistons of the radial piston motor remain mechanically coupled even if the piston group 20-2 that can be turned on or shut off is uncoupled from the working pressure, i.e. if it is deactivated. Since the speed of rotation of the axial [sic] piston motor is doubled in this operational state, i.e. in the standard case, there is the risk that the suction pressure in the region of the piston group that is shut off will drop below a pressure that is critical with regard to the occurrence of cavitation. This risk is particularly great if the motor is put into operation, i.e. starts up in the direction of rotation shown in FIG. 1 when the piston group 20-2 is shut off. In the following, an arrangement will be described that is included in the control circuit as necessary, if the risk of cavitation is supposed to be effectively reduced.

In order to counteract the occurrence of cavitation, the line segment 22 of the control circuit according to FIG. 1 is connected with a line that carries the control pressure X, by way of a check valve 60; in the case shown, this is the line segment 48. This optional, so-called "anti-cavitation valve 60" can, at the same time, be included in the optimization of the geometry of the orifice arrangement in the region of the infinitely adjustable directional valve 30. In other words, when coordinating the control signals for the infinitely adjustable pressure valve 40 with the geometry of the orifice arrangement in the region of the valve 30, the fluid stream that flows by way of the anti-cavitation valve 60 can be taken into consideration with regard to optimization of the switching time.

Figures 2, 2A, 2B:
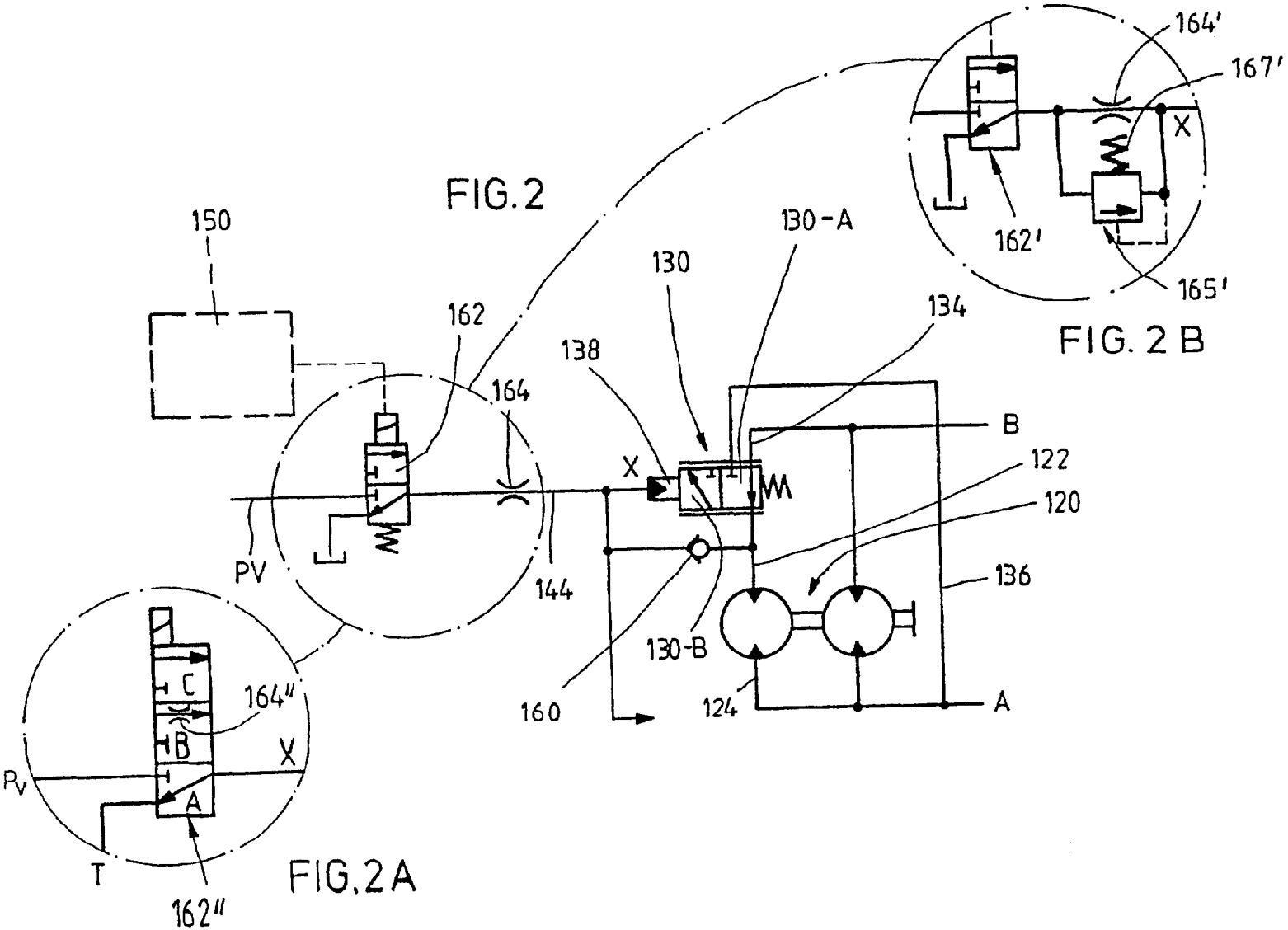
FIG. 2 shows the hydraulic circuit diagram of a modified version of the control circuit, in a representation corresponding to FIG. 1.
FIGS. 2A and 2B show segments of modified hydraulic circuit diagrams of embodiments in which the combination "orifice/directional valve" has been modified.

FIG. 2 shows another embodiment of the hydraulic control circuit for a radial piston motor having two speeds. To simplify the description, those parts that correspond to the embodiment according to FIG. 1 are provided with the same reference symbols, but with a "1" preceding them.

It is evident that this embodiment differs only in the region of the control for the infinitely adjustable 3/2-way valve 130. In other words, the control pressure X for the valve 130 is produced in a different manner in the embodiment according to FIG. 2, namely by switching in line a 3/2-way valve 162 that is preferably controlled electrically, and an orifice 164, in a line that carries a supply pressure PV. The 3/2-way valve in turn is controlled by a control electronics device 150, in such a manner as was described above with reference to FIG. 1. Control of the valve arrangement 130, in the embodiment according to FIG. 2, again takes place in that the valve body of the valve arrangement 130 can be moved through its intermediate switching position at a controlled speed.

FIGS. 2A and 2B show variants for the production of the control pressure X, where the only important point is the detail of the combination of orifice/directional valve.

In the variation according to FIG. 2A, the orifice 164" is integrated into the valve 162" that is structured as a 3/3-way valve, specifically in such a way that the orifice 164" exerts its function in the middle position B, while it does not exert any influence in the two other switching positions A and B [sic]. Control of the directional valve 162" is arranged in such a way that the valve slide is preferably activated at a reduced speed, particularly when passing through the middle switching position. The particular advantage of the arrangement is that as needed, additional flow medium can be fed into the control pressure line X, without being throttled, in order to ensure, in this manner, that additional hydraulic fluid can be drawn in, in a sufficient amount and under sufficient pressure, via the anti-cavitation valve 60, 160 that was described in greater detail with reference to FIG. 1.

Another variation of this mimicry, which further reduces the risk of cavitation, is shown in FIG. 21B. Here, the throttle 164' arranged downstream from the valve 162', which is furthermore structured as a 3/2-way valve, can be bridged by means of a sequential switching valve 165', if the control pressure X exceeds a threshold pressure that can be adjusted by means of a pre-tension spring 167'.

In the following, an embodiment of the valve arrangement as it can be used in the hydraulic switching circuits according to FIGS. 1 and 2 will be described in detail, referring to FIGS. 3 to 6. In these figures, also, those parts that correspond to the components of the hydraulic control circuits described above are also assigned similar reference symbols, preceded by a "2."

Figure 3:
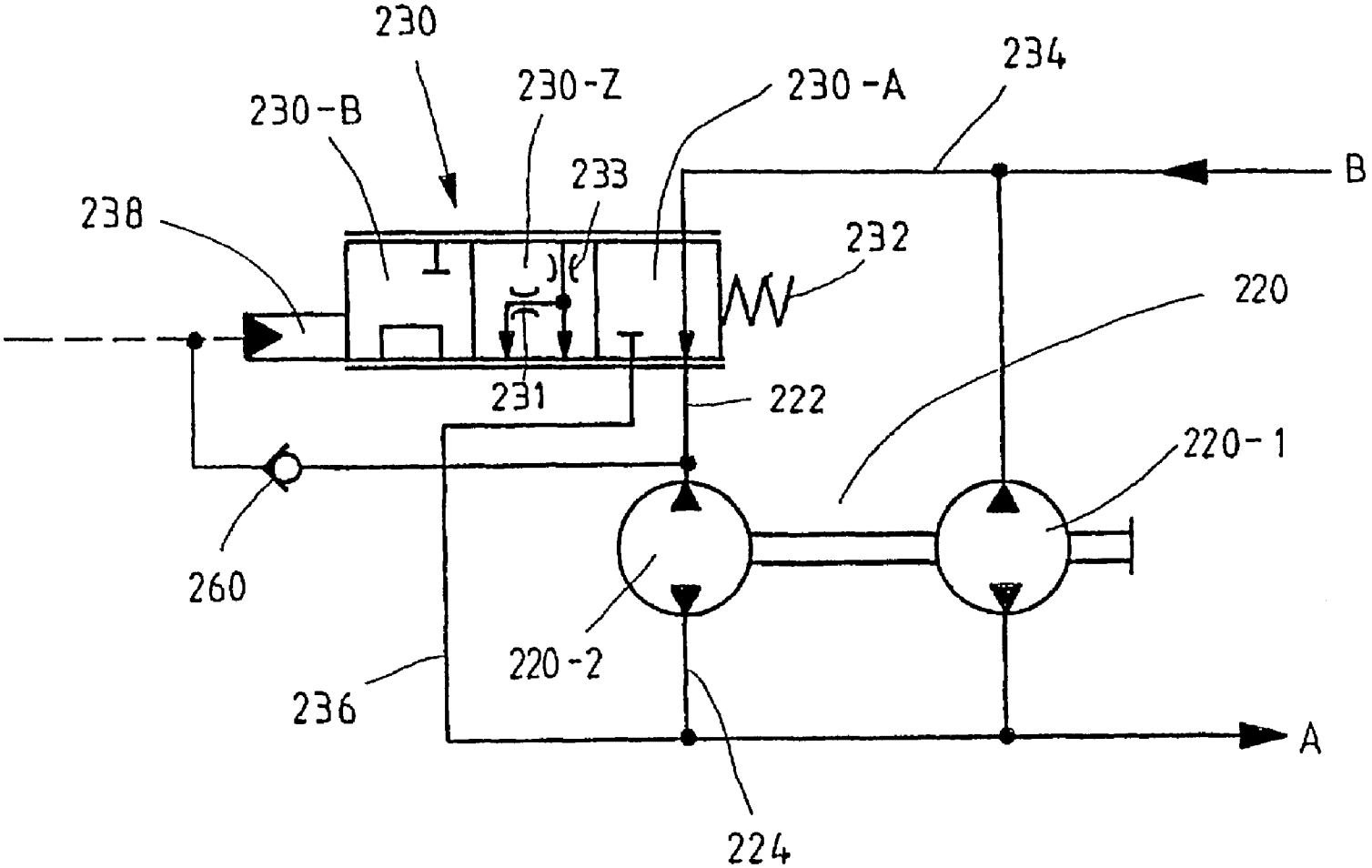
FIG. 3 shows a schematic representation of a detail of a hydraulic control circuit according to another embodiment.

FIG. 3 schematically shows the intermediate switching position 230-Z of the 3/2-way valve 230. It is evident that in the intermediate switching position 230-Z, the intake side 222 and the outlet side 224 are connected in throttled manner, i.e. by way of an orifice 231, where another orifice 233 throttles the pressure fluid stream to the piston group 220-2 between the supply line 234 and the intake line 222. Only in the second end switching position 23-B is the supply line 234 completely blocked, and the intake 222 and the outlet 224 of the piston group 220-2 is short-circuited, without throttling.

Figure 4A:
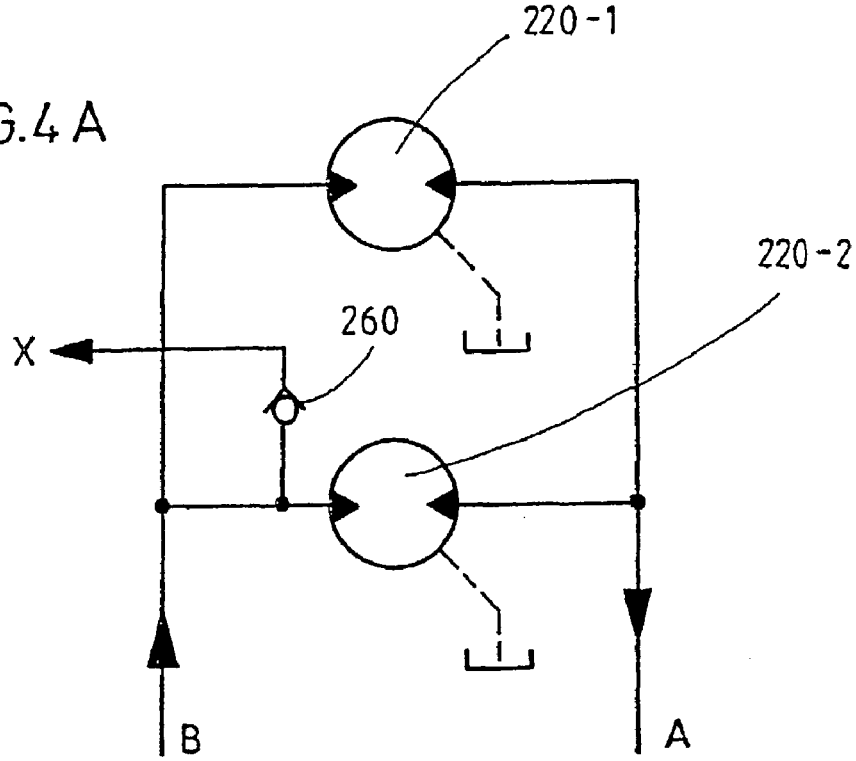
FIG. 4A shows a detail of a hydraulic control circuit according to another embodiment, which works with a valve arrangement according to the embodiment according to FIG. 3, for the case where the control pressure for the valve arrangement lies in a first, lower pressure range.

Making reference to FIGS. 4 to 6, a concrete construction of the 3/2-way valve 230 is described in greater detail below, in the three main positions. FIGS. 4A, 5A, and 6A each show the circuit for the switching position of the valve slide shown in FIGS. 4B, 5B, and 6B, respectively, in a detail.

Figure 4B:
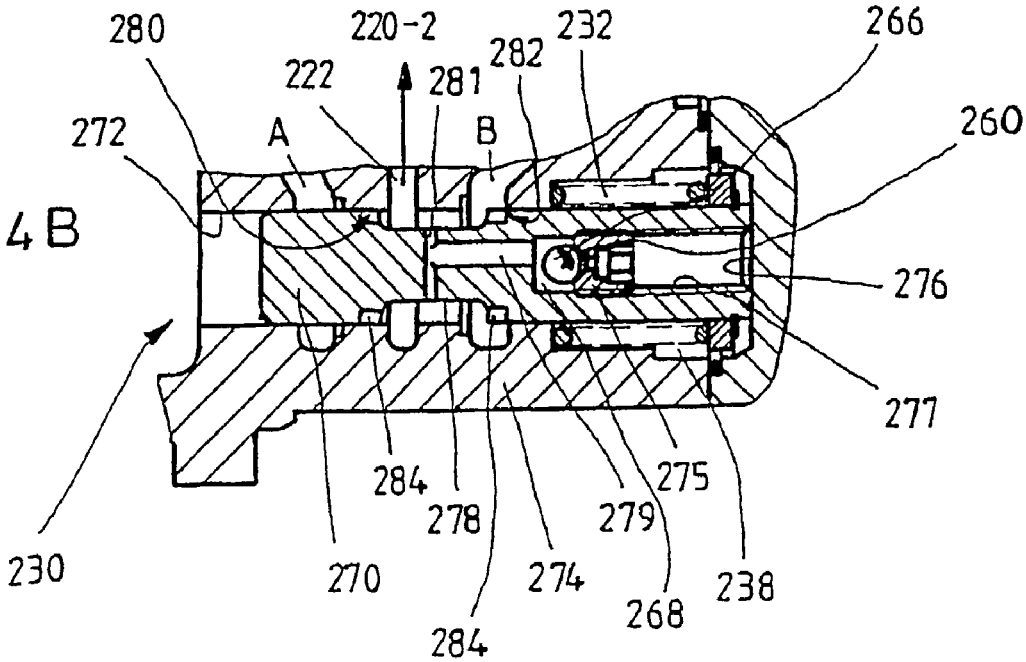
FIG. 4B shows a schematic cross-sectional view of the related infinitely adjustable directional valve of the valve arrangement in this operational state.

FIG. 4 shows the 3/2-way valve 230 in the switching position 230-A. A control slide 270 is held in a bore 272 of a motor housing 274, in the vicinity of the distributor bores for control of the individual radial pistons, which generally run axially, so as to move axially. A spring 232 tensions the control slide 270 towards the right, according to FIG. 4B, against a contact surface 276, which delimits a control space 238 that carries the control pressure "X."

Three connectors, namely connector B, connector A, and connector 222, which leads to the radial piston that can be turned on or shut off, i.e. to the radial piston group 220-2 that can be turned on or shut off, open into the bore 272. A recess in the control slide 270 is indicated with the reference symbol 278; this recess runs into the control edges 280, 282 at its edges. Axial slits 284 that are preferably uniformly distributed over the circumference are formed in the region of the control edges 280, 282. It is evident that in the switching position according to FIG. 4B, which the control slide assumes for a control pressure X in the range of 0 to 8 bar, for example, the connector B is switched through, unthrottled, to the intake connector 222 of the piston group 220-2. In this state, the radial piston motor 220 works at full torque, as is evident from FIG. 4A.

A so-called anti-cavitation valve is integrated into the control slide 270, and its structure will be described in greater detail below.

The side of the control slide that faces the contact surface 276 has a recess 277, preferably centered, into which a valve seat body 275 is screwed. The valve seat body interacts with a valve ball 266, which is held in a space 268, with play. An axial bore 279 proceeds from the space 268, meeting a keyhole bore 281 that opens into the recess 278 of the control slide. The geometry and the position of the valve ball 266 is coordinated with the geometry and the position of the axial bore 279, in such a way that the valve ball 266 cannot close off the axial bore 279. However, the pressure that is applied via the connector B, the keyhole bore 281, and the axial bore 279 can press the valve ball 266 onto the valve seat of the valve seat body 275, as long as a corresponding pressure gradient is present.

If the speed of rotation of the radial piston motor is supposed to be increased, i.e. generally doubled, the control pressure X is raised into a higher pressure range, in which the switching process takes place, in the manner as described with reference to FIGS. 1 and 2. For this pressure range, which lies between 8 and 13 bar, for example, in the embodiment according to FIGS. 4 to 6, the control slide 270 assumes the position shown schematically in FIG. 5. Here, the control pressure X is sufficiently great to lift the control slide from the contact surface 276, counter to the force of the spring 232, and to push it to the left, according to FIG. 6B, so far that the connection from connector B to connector 222, on the one hand, and the connection between connector 222 and connector A, i.e. to the outlet side of the piston group that is to be shut off, on the other hand, is throttled through axial slits 284-B and 284-A, respectively. The reference symbols 286-B and 286-A in FIG. 5B stand for the precision-machined control edges that run around the housing and interact with the axial slits 284-B, 284-A.

Figure 5A:
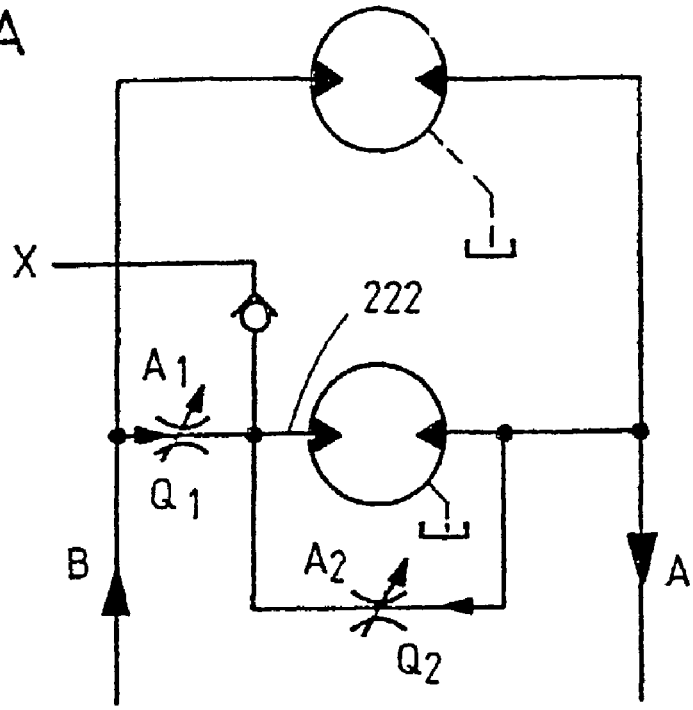
FIG. 5A, FIG. 5B show representations corresponding to FIGS. 4A and 4B for the case where the control pressure of the valve arrangement lies in a medium pressure range.
Figure 5B:
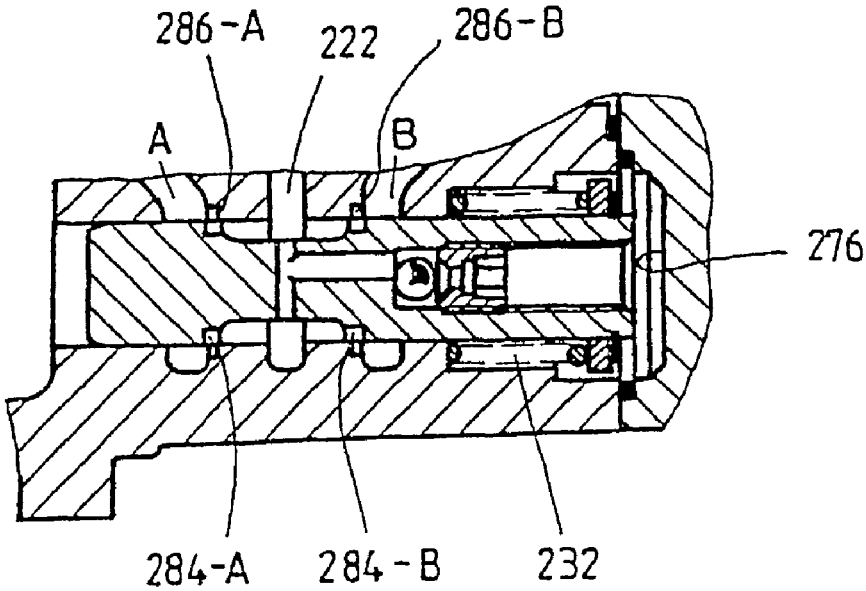
Figure 6A:
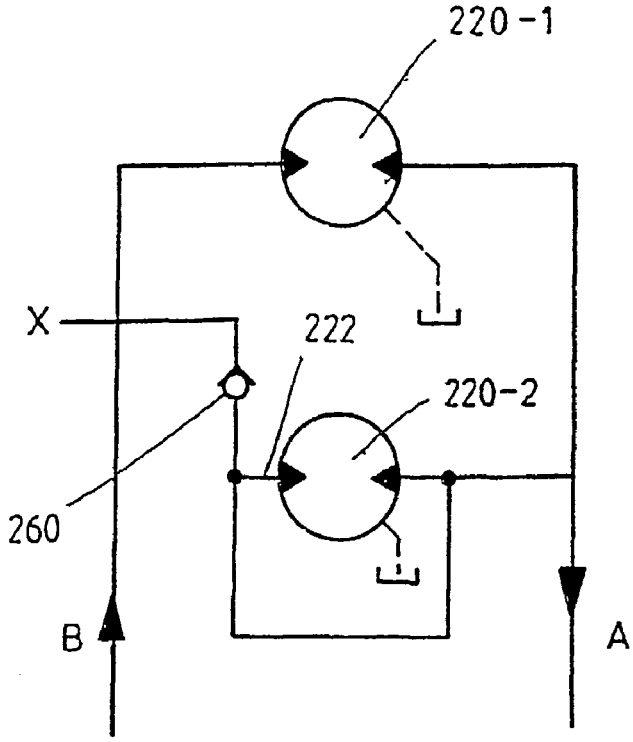
FIG. 6A, FIG. 6B show representations corresponding to FIGS. 4A and 4B for the case where the control pressure lies above a medium pressure range.
Figure 6B:
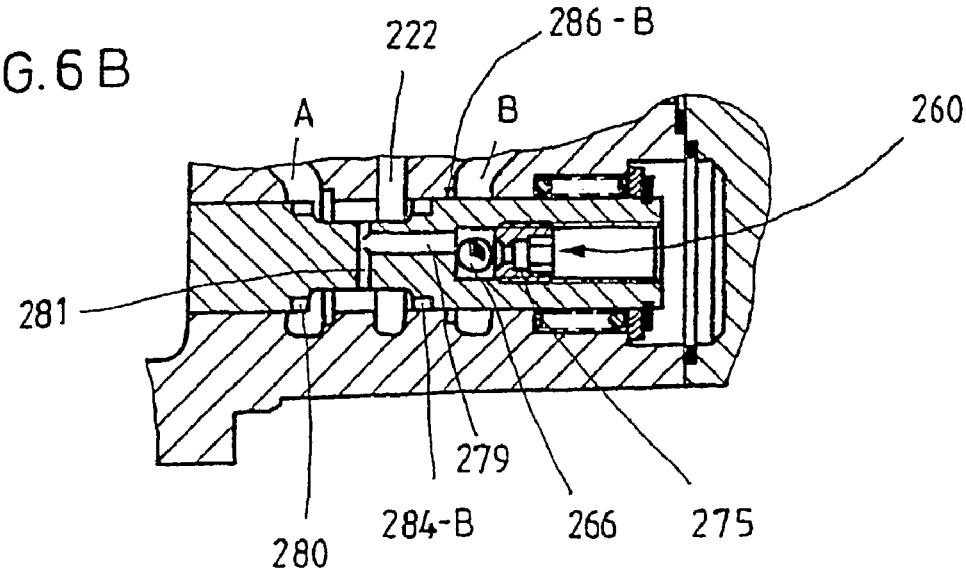

FIG. 5A shows this switching state with the adjustable throttles A1 and A2, where the throttle location A1 corresponds to the axial slits 284-B and the throttle location A2 corresponds to the axial slits 284-A.

As was explained with reference to FIGS. 1 and 2, the intermediate switching position shows in FIG. 5 is passed through in controlled manner, where the control pressure X is preferably elevated in programmed manner, and in accordance with a gently rising ramp, for example. As soon as the control pressure X has reached a certain upper threshold value of 13 bar, for example (in the embodiment shown), the 3/2-way valve assumes the second end switching position according to FIG. 6. The axial slits 284-B have completely run over the complementary control edge 286-B for the connector B in this switching state, while the control edge 280 on the side of the connector A controls the connection between the connector 222 and the connector A to be open, unthrottled.

In this switching state, the radial piston motor works at an increased speed of rotation, generally double. However, since constant mechanical coupling of all the pistons of the radial piston motor exists via the stroke cam and the rotor, the pistons of the deactivated piston group(s) 220-2 is/are also accelerated. In order for the flow medium pressure not to drop below a critical pressure that will bring about the occurrence of cavitation, on the suction side 222 of the piston group 220-2, the anti-cavitation valve, i.e. the check valve 260 goes into operation. As soon as the pressure in the connector 222 is too low, the ball 266 is lifted up from the valve seat body 275, so that hydraulic fluid can be fed into the connector 222 under the pressure of the control pressure X, via the axial bore 279 and the keyhole bore 281. This method of operation of the valve 260 is also particularly important if the radial piston motor is started in the high-speed stage shown in FIG. 6. The particular feature of the embodiment described above is that the anti-cavitation valve is housed in the 3/2-way valve 230 in particularly space-saving manner.

Switching the radial piston motor from the high-speed stage to the low-speed stage is brought about by a corresponding reduction in the control pressure X, where again, the control slide follows its path from the one end switching position to the other at a controlled speed. During this switching process, the control slits 284-B and 284-A are again used to counteract pressure peaks in the region of the connectors that are to be opened and closed, and in the final analysis, this has the result that the switching process takes place in non-jerky manner and thereby in gentle manner for the individual components of the radial piston motor.

The embodiment of the hydraulic control circuit as described above is also operational if the direction of rotation of the radial piston motor is reversed, in that fluid under working pressure is fed into the connector A. The advantages of the control of the 3/2-way valve according to the invention as already described are maintained when this happens. However, in this case, in the high-speed switching position according to FIG. 6, there is the disadvantage that the intake and the outlet of the deactivated motor piston group are impacted with high pressure, which results in undesirable power losses, in the final analysis. With reference to FIGS. 7 to 16, an embodiment is described that is structured in such a way that it can be utilized with an equal degree of effectiveness in both directions of rotation of the radial piston motor. In this embodiment, again, those components that correspond to the components of the exemplary embodiments described previously are provided with similar reference symbols, but these are preceded by a "3."

Figure 7:
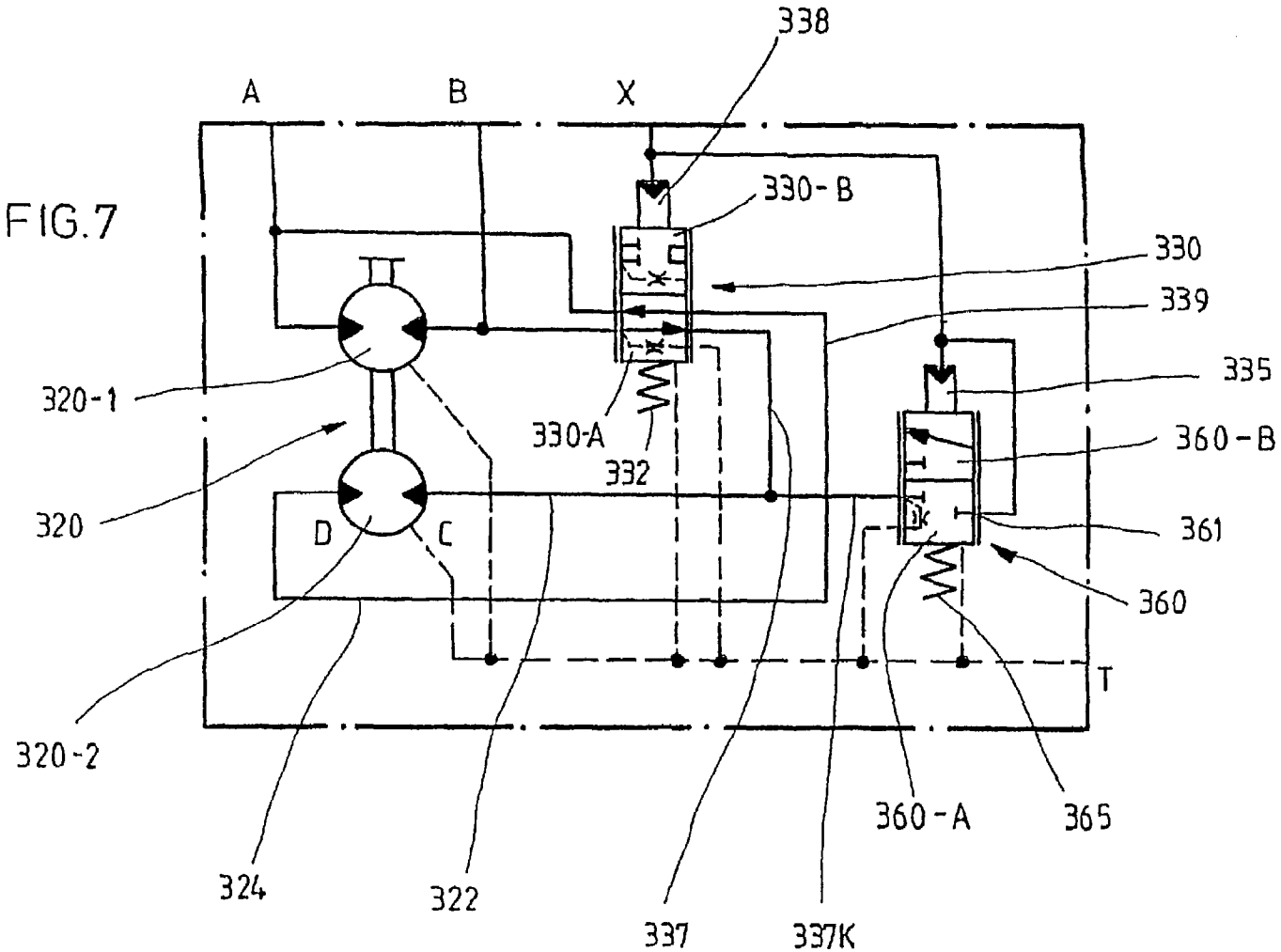
FIG. 7 shows a segment of a control circuit with another embodiment of the hydraulic control circuit for a radial piston motor having two speeds, which does not have a preferred running direction.

The radial piston motor shown in FIG. 7 can be operated in the so-called "4 connectors configuration," i.e. it can be operated both for the full absorption volume and for half the absorption volume, in both directions of rotation, with the same degree of effectiveness. For this purpose, the valve arrangement that was structured as an infinitely adjustable 3/2-way valve in the embodiments according to FIGS. 1 to 6 is structured as an infinitely adjustable 4/2-way valve 330, with its two end switching positions 330-A and 330-B being shown in FIG. 7.

In place of the check valve 60, 160, or 260, respectively, the embodiment according to FIG. 7 has an infinitely adjustable 3/2-way valve 360 with the two end switching positions 360-A and 360-B. The control connector 338 of the 4/2-way valve 330 in turn is connected to the line that carries the control pressure X. This control pressure X is furthermore passed to a control side 335 of the valve 360, which will be referred to as an anti-cavitation valve in the following.

In the end switching position 330-A of the valve 330, the pressure in the intake of the constantly working motor piston, i.e. the constantly working motor piston group 320-1, is switched through to a first connecting line 337, which leads to the intake 322 of the motor piston (motor piston group) 320-2 that can be turned on or shut off. At the same time, the valve 330 switches the outlet 324 of the motor piston group 320-2 through to the outlet connector A via the second connecting line 339.

In the switching position 360-A of the anti-cavitation valve 360, when it is held against the control connector 335 counter to the [controlling torque], under the influence of a pull-back spring 365, as shown in FIG. 7, a branch line 337K is closed; however, throttled drainage to tank pressure level is provided. At the same time, a connector 361 that is connected with the control connector 335 is closed in this switching position.

In the high-speed switching position of the two valves 330 and 360, the following circuit prevails:

In the switching position 330-B, the control slide of the valve 330 closes the connection between the connector B that carries the working pressure and the first connecting line 337, as well as the connection between the second connecting line 339 and the outlet connector A. The first and second connecting line 337, 339 are short-circuited, so that the motor piston group 320-2 can no longer make any contribution to increasing the torque. Since the speed of rotation of the motor increases in this switching state, and the individual pistons 320-1 and 320-2 continue to be mechanically coupled, the connector C, i.e. 322 of the piston group 320-2 is at risk of cavitation. For this reason, the valve slide of the anti-cavitation valve 360 assumes the switching position 360-B in this operational state, in which the connector 361 that carries the control pressure X is switched through to the branch line 337K and therefore to the connector 322. An under-supply of the suction region of the motor piston group 320-2 is thereby effectively prevented.

Just as in the case of the exemplary embodiments described above, also in the case of the embodiment according to FIG. 7, it is ensured, on the basis of the special structure of the infinitely adjustable directional valve 330, that switching from one speed level to the other takes place free of surges or jerky movements, in that the intermediate switching positions of the valve 330 are utilized and passed through in controlled manner. Making reference to FIGS. 8, 8A, a concrete structure of the 4/2-way valve with an integrated anti-cavitation valve 360 will be explained in greater detail below. For those components that correspond to the components of previous embodiments, again corresponding reference symbols will be used, with a "3" preceding them.

In deviation from the exemplary embodiments previously described, a valve slide, i.e. control slide 370 is held in the bore 372 of a valve insert 371, so that it can be moved axially. The valve insert 371 is mounted in a distributor part 374, with a seal, so that the space on the right side, according to FIG. 8, of the valve slide 370 is connected with a region of low pressure in the system, for example the tank pressure.

Figures 8, 8A:
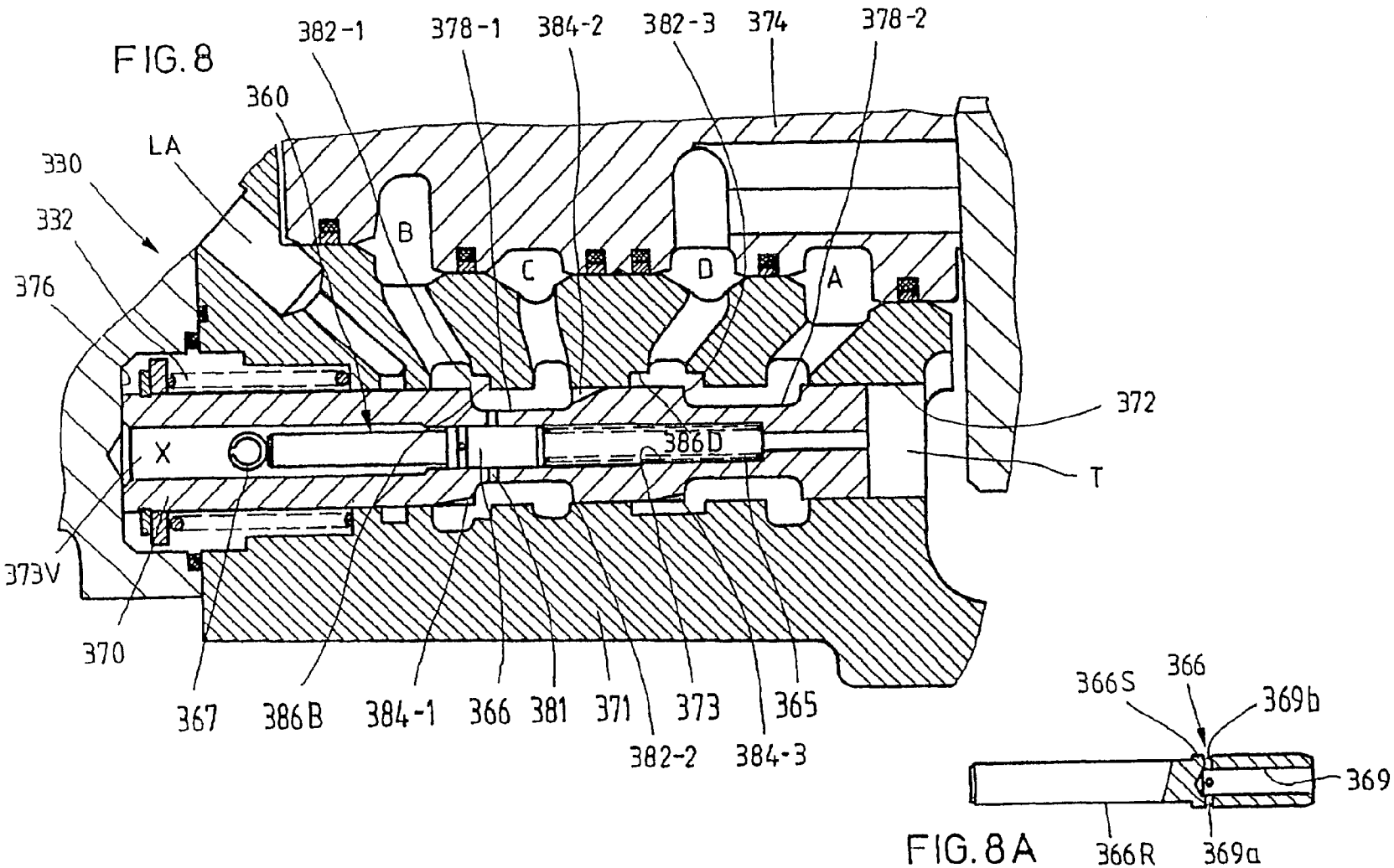
FIG. 8 shows a side view of an embodiment of the valve arrangement used in the hydraulic control circuit according to FIG. 7.
FIG. 8A shows a partial cross-section of an individual representation of the valve slide of the 3/2-way valve used in the embodiment according to FIGS. 7 and 8.

The valve slide 370 has a stepped bore 373, in the center segment of which a valve body 366, in the form of a cylindrical slide, is held with an accurate fit and so it can be moved axially. The valve body 366 is supported on a pressure spring 365 on the right side, according to FIG. 8, which presses the valve body 366 against a holding pin 367 in its position as shown in FIG. 8. The valve body 366 has a bore 369 on the side that faces the low-pressure region, into which several radial keyhole channels 369*a* open at their ends; these channels proceed from a ring groove 369*b*. The valve body 366 interacts with a control bore 381 formed in the control slide 370, which bore runs radially to the outside and opens into a first piston recess 378-1 of the piston slide 370.

As is evident from FIGS. 8, 8A, the valve body 366 has a segment with a reduced diameter 366R on the side facing away from the dead-end bore 369, so that a piston shoulder 366S is formed. Segment 366R of the valve body 366 projects into a segment 373V in the interior of the control slide 370, which has the control pressure X applied to it on this side.

Similar to the construction according to FIGS. 4 to 6, the control slide 370 is pre-stressed in a contact position shown in FIG. 8, by means of a pressure spring 332 (corresponds to the position 330-A of the valve 330 according to FIG. 7), in which the left face, according to FIG. 8, is held against a contact surface 376. The contact surface delimits a space that is connected, in terms of flow medium, with the control pressure X. There is a pressure connection between the space 373V and the space in which the pressure spring 332 is held, by way of radial recesses in the face of the piston slide 370, not shown in greater detail.

Channels that lead to the related connectors A, D, C and B (see FIG. 7) open into the bore 372 that holds the control slide 370. A leakage connector is indicated with LA. The piston recesses 378-1 and 378-2 form control edges 382-1, 382-2, and 382-3, in the region of which there are axial slits 384-1, 384-2, and 384-3, similar to the variant of the valve 230 according to FIGS. 4 to 6. The connecting channels for the connectors B and D each open into a lathed recess 386B and 386B, respectively.

With the structure of the 4/2-way valve 330 as described above, with an integrated anti-cavitation valve 360, there is the following method of operation, which will be explained in greater detail using FIGS. 9 to 14.

Figure 9A:
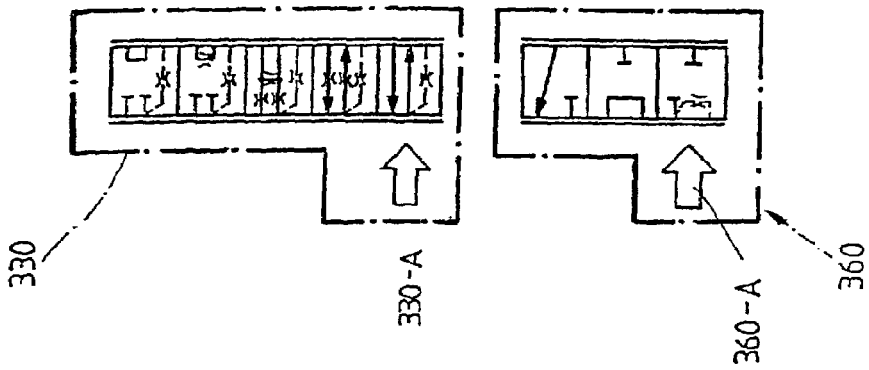
FIG. 9 shows the view according to FIG. 8, on a somewhat smaller scale, in an operational state in which the control pressure lies in a first, lower pressure range, while in FIG. 9A the related switching positions of the valve slides are indicated.
Figure 9:
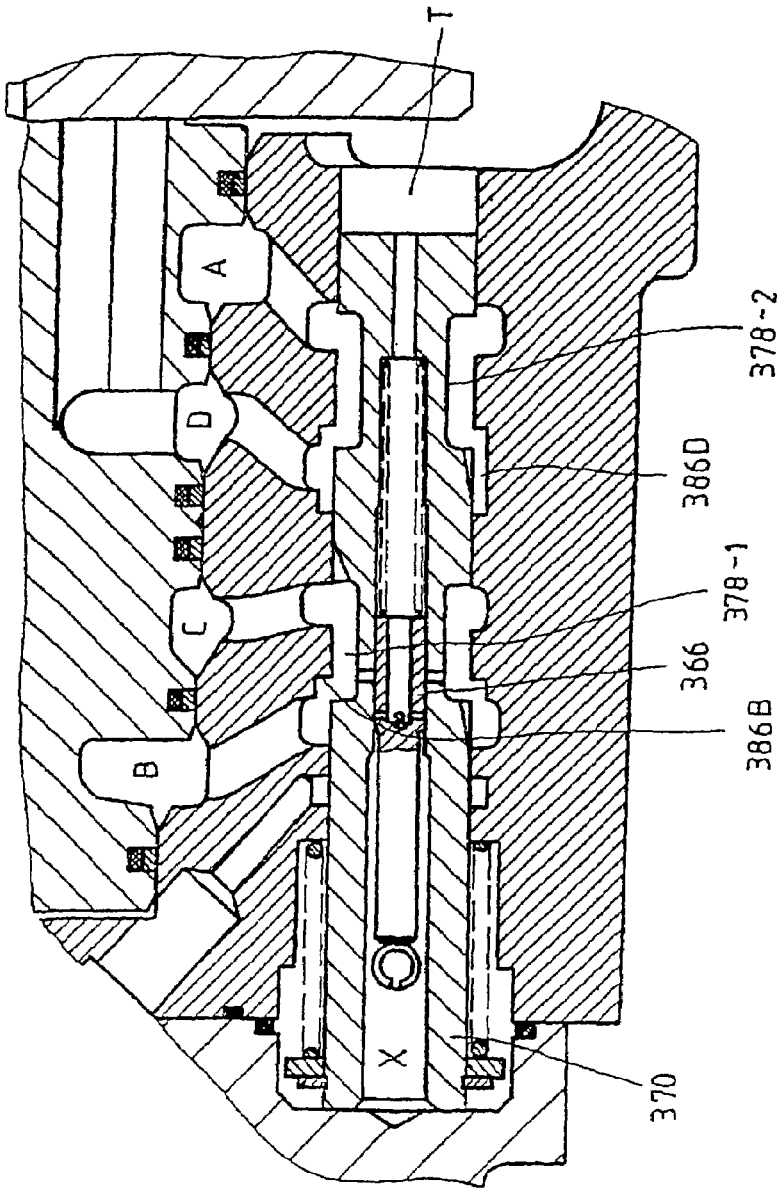

FIG. 9 shows the two valves 330 and 360 in their end switching positions 330-A and 360-A, in each instance. The connector B is connected, unthrottled, with the connector C, by way of the lathed recess 386B and the piston recess 378-1, so that the motor piston group 320-2 that is to be turned on and shut off is equally provided with working fluid under working pressure, along with the piston group 320-1. At the same time, the outlet sides of the motor piston group 320-1 and 320-2, in each instance, are connected without throttling, in that the connector A is connected with the connector D by way of the second piston recess 378-2 and the lathed recess 386D.

The valve body 366 of the anti-cavitation valve 360 assumes a position in which the connection between the connector C and a low-pressure space, i.e. a tank pressure space T is blocked, in that the valve body 366 closes off the radial channels 381 in the control slide 370. The valve arrangement is held in the position shown in FIG. 9 for as long as the control pressure X does not exceed a predetermined first threshold value of 4 bar (corresponds to 58 psi), for example.

Figure 10A:
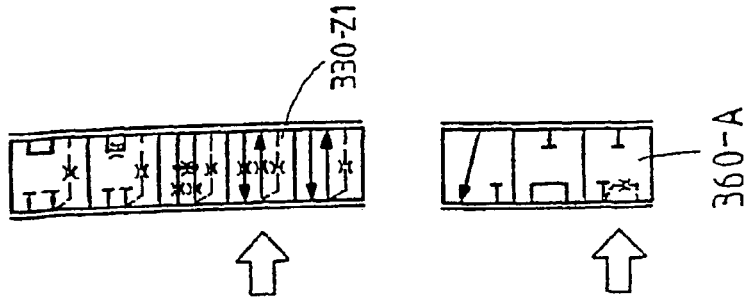
FIGS. 10 and 10A show representations according to FIGS. 9 and 9A for the case where the control pressure lies in a second, lower pressure range.
Figure 10:
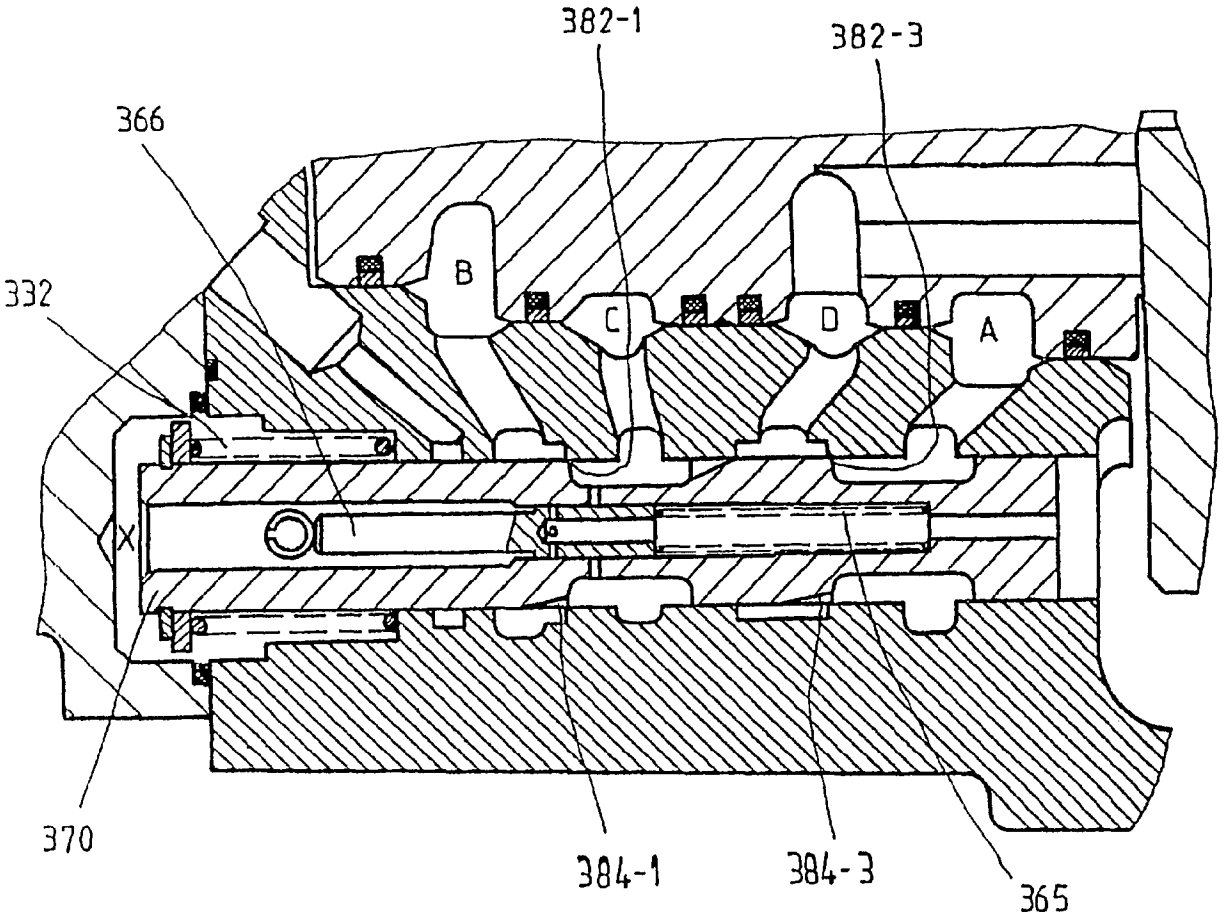

As soon as the control pressure X exceeds this first threshold value, the control slide 370 moves to the right, according to FIG. 10, counter to the force of the pull-back spring 332, so that the control edges 382-1 and 382-3 go into operation. Because of the axial recesses 384-1 and 384-3, a throttled connection between the connectors B and C, on the one hand, and the connectors A and D, on the other hand, is maintained.

In this operational state, the control pressure X is not yet able to move the valve body 366 against the force of the pull-back spring 365, so that the anti-cavitation valve remains in the end switching position 360-A. The first intermediate switching position of the infinitely adjustable 4/2-way valve 330 is indicated as 330-Z1 in FIG. 10A. This switching position is held in a pressure window between 4 and 7.7 bar (between 58 and 112 psi), for example.

Figure 11A:
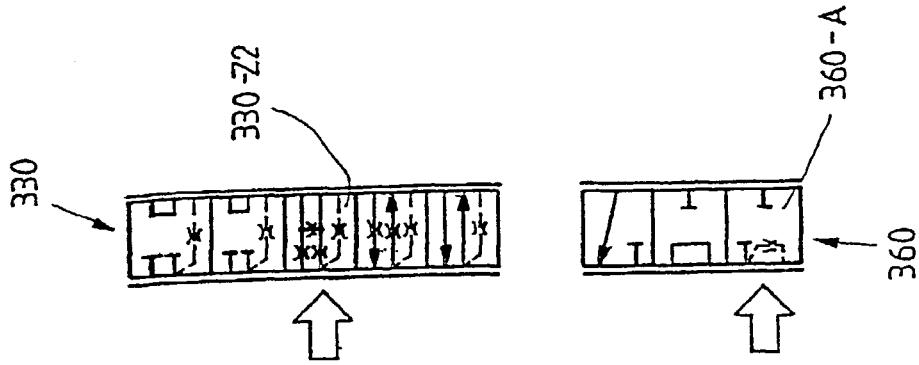
FIGS. 11 and 11A show representations according to FIGS. 10 and 10A for the case where the control pressure lies in a medium pressure range.
Figure 11:
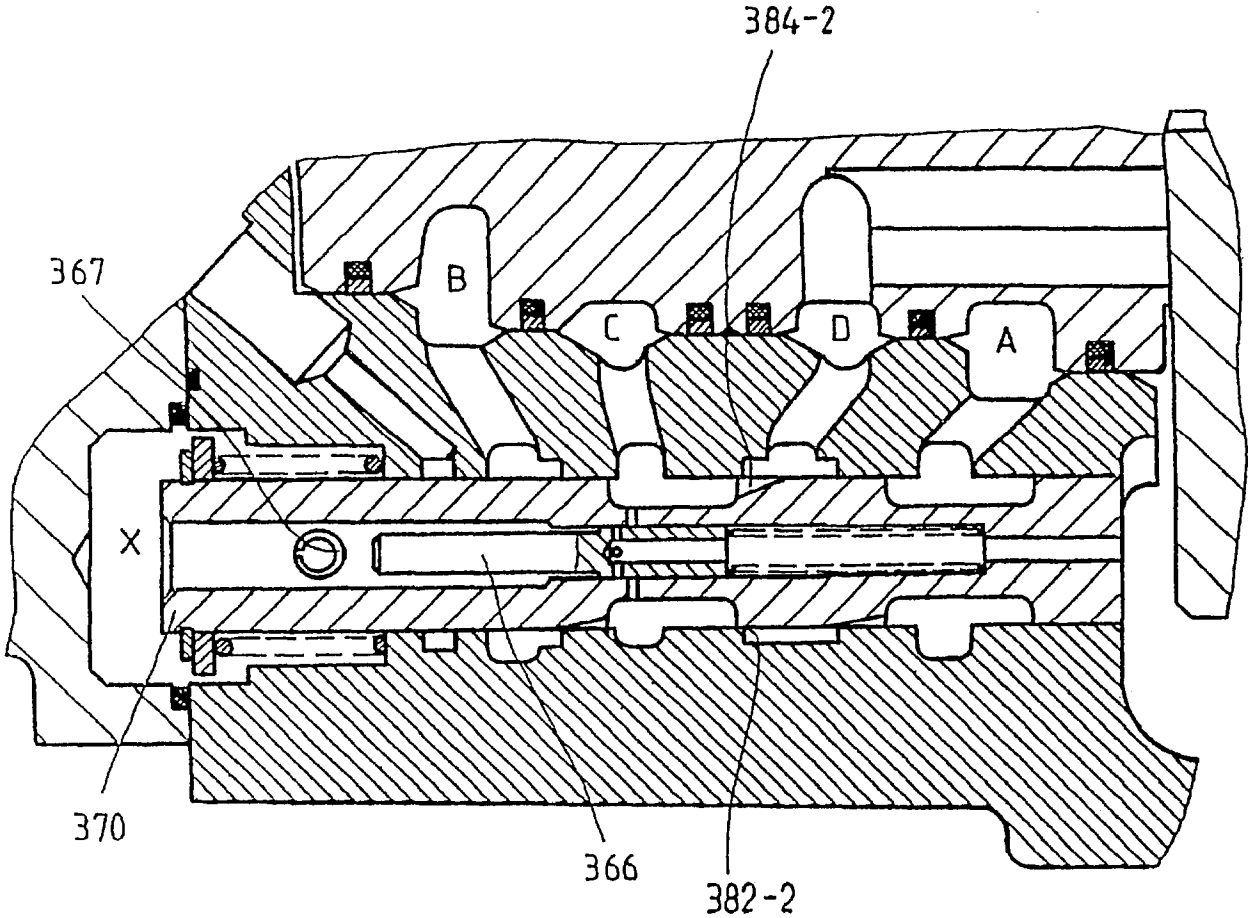

If the control pressure X increases further and reaches a second threshold value of 7.7 bar (corresponds to 112 psi), for example, the control slide 370 moves further to the right, according to FIG. 11. In this position, there continues to be a throttled connection between the connectors B and C, on the one hand, and between the connectors A and D, on the other hand. At the same time, however, another throttled connection is built up between the connectors C and D, by way of the second control edge 383-2, and, specifically, via the axial recesses 384-2. This second intermediate switching position is indicated as 330-Z2 and is implemented in a second pressure window that is maintained in a range between 7.7 and 15 bar (corresponds to a range between 112 and 218 psi), for example. Although the control pressure X is already sufficiently great here to lift the valve body 366 off the contact pin, the anti-cavitation valve 360 remains in the end switching position 360-A.

If the control pressure X is increased further and reaches a pressure window of 15 to 16 bar (corresponds to 218 to 232 psi), for example, the control edges 382-1 and 382-3 completely close the connections between B and C, on the one hand, and between D and A, on the other hand, so that the infinitely adjustable 4/2-way valve 330 assumes a third intermediate switching position 330-Z3, in which the connection between the connectors C and D, i.e. the short-circuiting of the intake and outlet side of the motor piston groups 320-2 that can be turned on and shut off takes place in throttled manner, because the axial recesses 384-2 are still active.

Figure 12A:
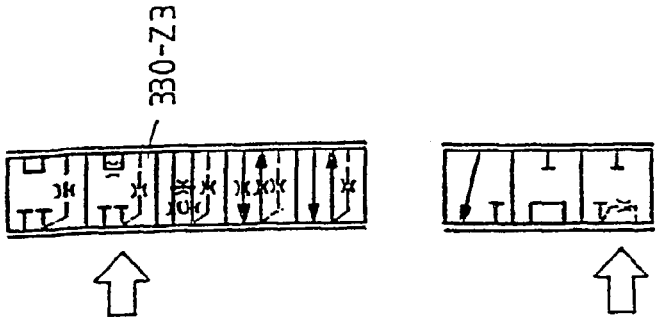
FIGS. 12 and 12A show views corresponding to FIGS. 10 and 10A for the case that the control pressure is in a fourth pressure range.
Figure 12:
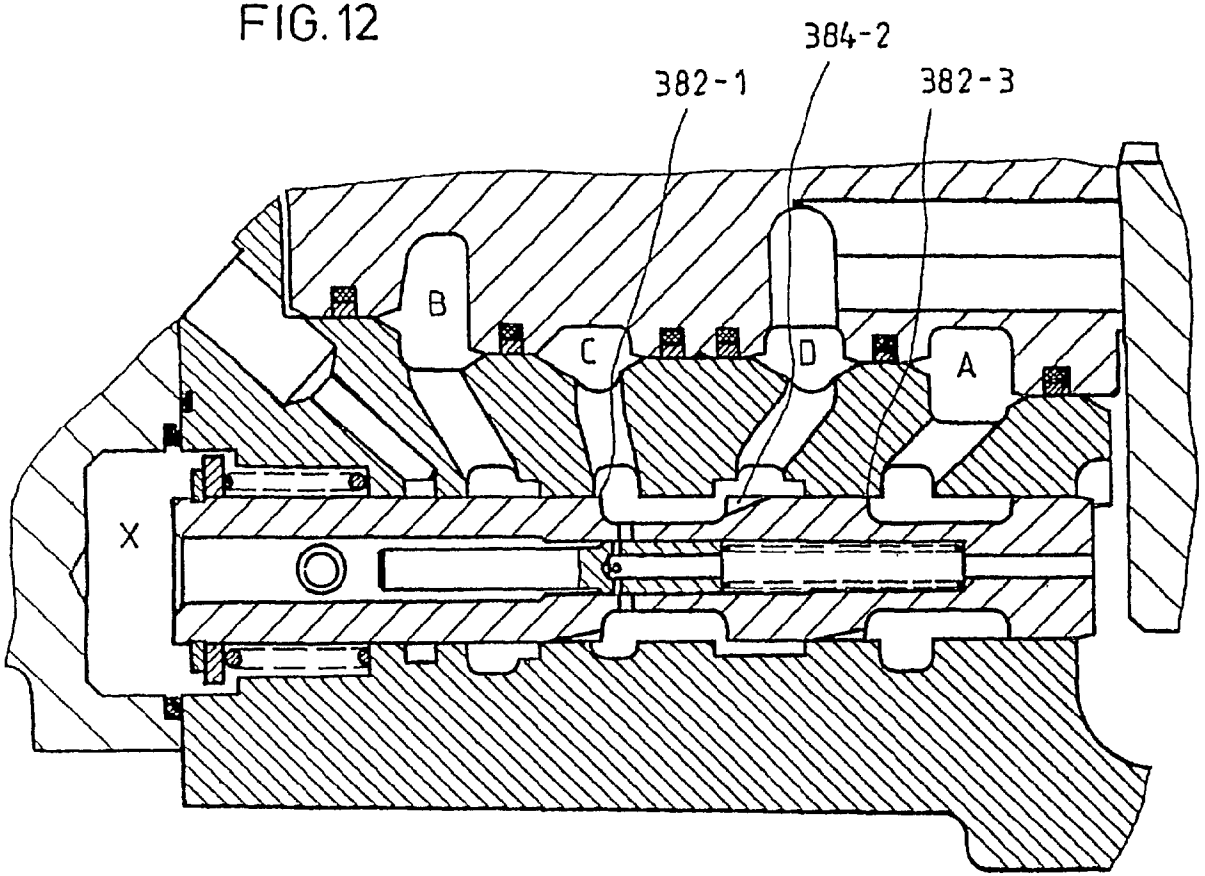
Figure 13A:
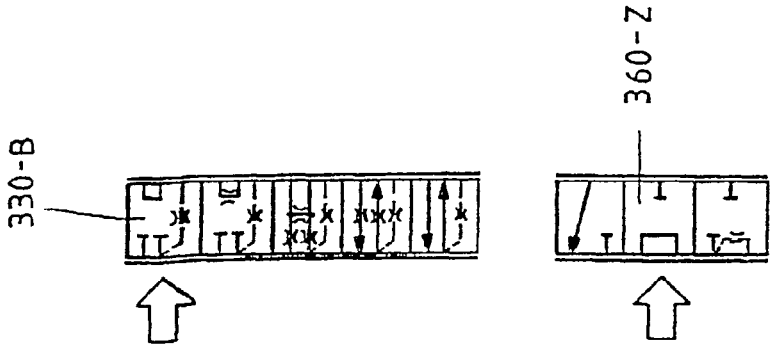
FIGS. 13 and 13A show views corresponding to FIGS. 10 and 10A for the case that the control pressure lies in a fifth pressure range.
Figure 13:
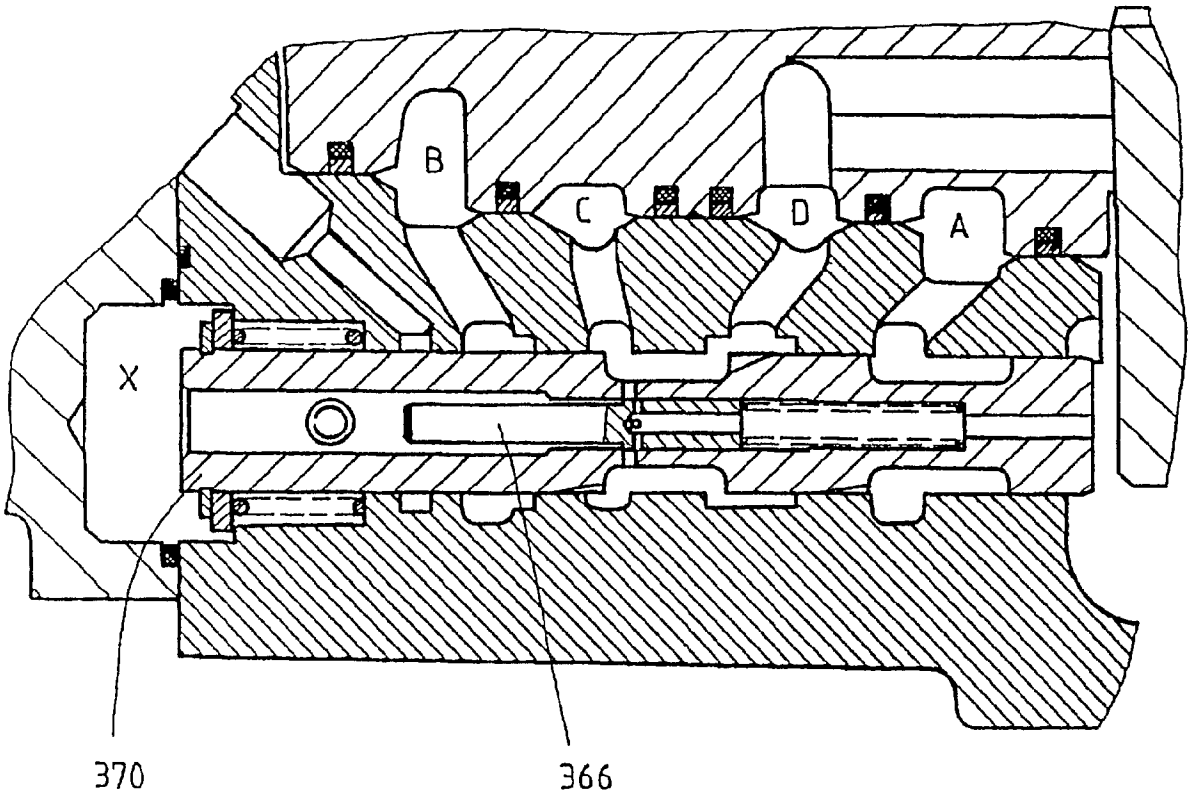

As soon as the control pressure X leaves the pressure window according to FIG. 12, i.e. enters into the pressure range between 17 and 19 bar (247 to 276 psi), for example, the control slide 370 reaches its second end switching position 330-B, which is shown in FIGS. 13, 13A and represents a contact switching position. Differing from the shifted position according to FIG. 12, the connection between the connectors C and D is not controlled to be open, unthrottled. In this phase, the control pressure X has assumed a sufficiently large value to move the valve body 366 into an intermediate switching position 360-Z (see FIG. 13A). In this switching position, a connection of the connectors C and D to the tank side T is produced for a short period of time, in order to keep energy losses as low as possible in the region of the motor pistons, i.e. motor piston group that is short-circuited in this operational state and deactivated.

Figure 14A:
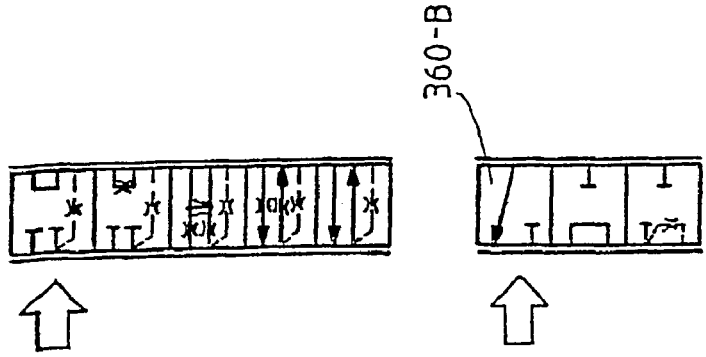
FIGS. 14 and 14A show representations corresponding to FIGS. 10 and 10A for the case that the control pressure lies above the fifth pressure range.
Figure 14:
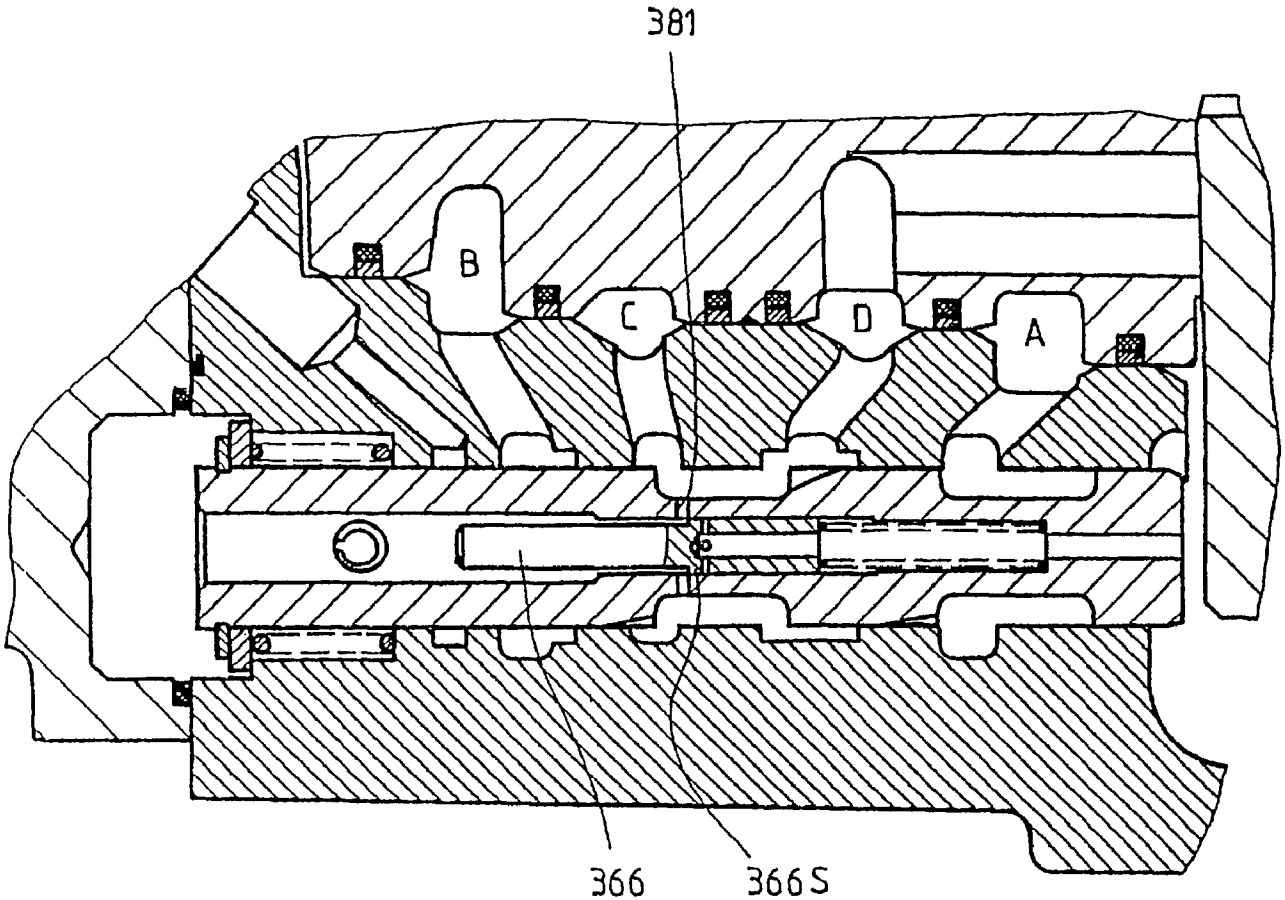

Since the speed of rotation of the axial [sic] piston motor is increased, i.e. generally doubled, the anti-cavitation valve 360 now goes into operation to secure the suction side of the motor piston group 320-2 that can be turned on and shut off, as follows:

When the control pressure X reaches the highest threshold value, for example 19 bar (corresponds to 276 psi), the valve body 366 is pushed to the right, according to FIG. 14, so far that the shoulder 366S opens the radial channel 381. This connects the connectors C and D with the control pressure X, i.e. the side of the motor piston group 320-2 that can be turned on or shut off, which is to be secured against cavitation, is reliably supplied with flow medium that is under sufficiently high pressure so that the suction pressure in the motor piston in question does not go below a critical limit value. The anti-cavitation valve 360 thereby assumes the second end switching position 360-B.

From the above description, it is clear that the method of operation of the valves 330 and 360 is equally ensured if the direction of rotation of the radial piston motor is reversed. It must furthermore be emphasized that switching between the speeds, without jerky movements, as implemented with the control of the valves 330 and 360 according to the invention, is as gentle as possible on the components, and is also ensured for the case where the radial piston motor starts in the switching position of the valves according to FIG. 14, i.e. in high-speed operation, and is subsequently switched to operation at half the speed of rotation and twice the torque. In this case, the control pressure X is reduced in controlled manner, so that the switching positions according to FIGS. 14, 13, 12, 11, 10, and 9 are assumed, one after the other.

The embodiment according to FIGS. 8 to 14 is thereby characterized by a very space-saving construction. The valve arrangement with the infinitely adjustable 4/2-way valve 330 and the anti-cavitation valve 360 can easily be housed in the housing part of the radial piston motor, where the modular construction actually opens up the possibility of retrofitting commercially available radial piston motors with the valve arrangement according to the invention.

The time progression with which the control pressure X is changed when switching the radial piston motor between the different speeds is preferably again program-controlled, as was already explained with reference to FIGS. 1 and 2, so that an adaptation to the different operational states of the radial piston motor can take place using simple means. Of course, the positive overlap of the control edges in the region of the control slide 370 can be varied within wide limits, in order to undertake fine-tuning to the particular areas of use of the radial piston motor, in each instance.

Figure 15:
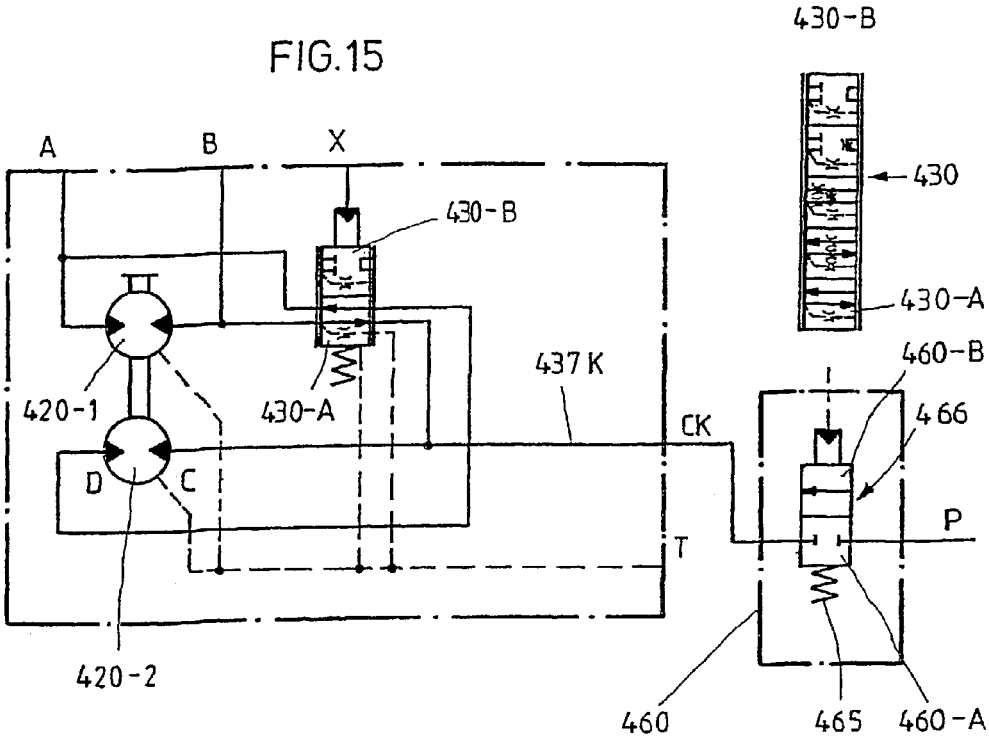
FIG. 15 shows segments of another embodiment of a hydraulic control circuit having a modified version of a valve to prevent cavitation wear of the radial piston motor.
Figure 16:
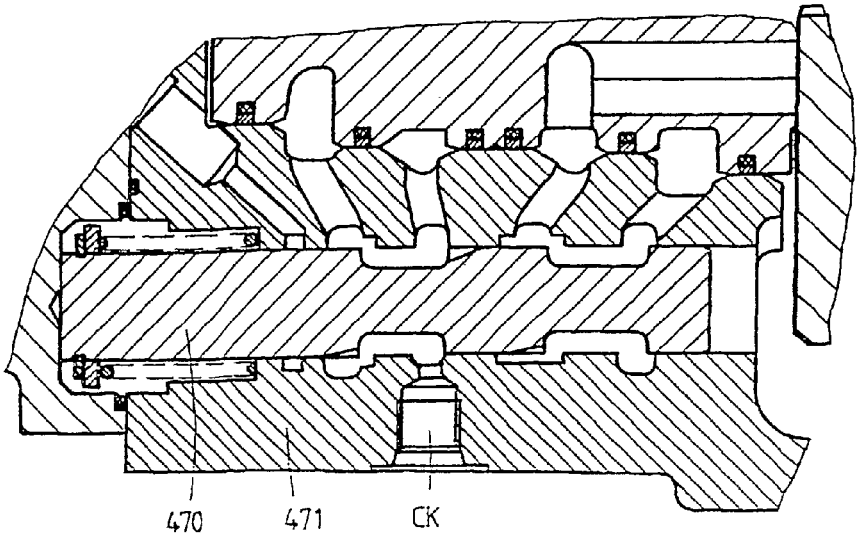
FIG. 16 shows a schematic side view of the 4/2-way valve used in FIG. 15.

Finally, another exemplary embodiment of the control circuit according to the invention is presented, making reference to FIGS. 15 and 16, where the protection of the radial piston motor against cavitation phenomena is brought about in a different manner. To simplify the description, also in this embodiment, the components that correspond to the components of the embodiment according to FIGS. 8 to 14 are indicated with similar reference symbols, but preceded by a "4."

In the embodiment according to FIG. 15, an anti-cavitation valve indicated as 460 is structured as an external 2/2-way valve. It has a valve slide 466 that can be moved from its closed position 460-A into its throughput position 460-B counter to the force of a pull-back spring 465; in the latter position, the system pressure P is switched through to the branch line 437K and thereby to the connectors C, i.e. C and D, if the motor piston group 420-2 is deactivated in the switching position 430-B of the infinitely adjustable 4/2-way valve 430, and therefore the radial piston motor is running at increased, i.e. double speed.

Accordingly, a control slide 470 of the infinitely adjustable 4/2-way valve 430 can be implemented in simplified manner, i.e. as a full piston, where another connector CK for coupling the line that comes from the anti-cavitation valve 460 is provided in an insertion body 471. Otherwise, the structure of the valve according to FIG. 16 corresponds to that of the embodiment according to FIGS. 8 to 14, so that a more detailed description is not necessary.

Of course, deviations from the embodiments described above are possible, without thereby leaving the fundamental idea of the invention. For example, the hydraulic control circuit can also be implemented as a unit uncoupled from the motor.

Likewise, it is possible to house the valves in the rotor housing instead of in the motor housing. Also, the hydraulic control circuit can, of course, be used for radial piston motors in which the speed of rotation is changed in several steps.

In place of the valve arrangement shown, which has the advantage that an existing control slide merely has to be restructured slightly and that can be implemented with great space savings, of course it is also possible, in order to achieve the advantages according to the invention, to install a proportional directional valve in the pressure supply line of the motor piston group to be turned on or shut of, where then the control is also selected in such a way that no excessive pressure peaks occur in the individual components of the control circuit and at the components involved in the transfer of force, so that the switching process can be implemented in gentle manner and without pressure.

Finally, it is also possible to make the axial slits that are responsible for the positive overlap of the control edges on the infinitely adjustable directional valve in the part that forms the valve slide bore, either alone or additionally. By means of a suitable adaptation of the geometry of these axial recesses, the throttling behavior for the individual pressure lines and pressure connectors can be adapted to the time progression of the signal for the control pressure X, thereby also making it possible to use different signal progressions for generating the control pressure X, for different switching directions and/or for different directions of rotation of the radial piston motor.

Above, the embodiments were described on the basis of use of the control circuit according to the invention in a radial piston motor according to the multi-stroke principle. However, it is emphasized that the invention is not limited to this area of use. Instead, the control circuit is suitable for all hydraulic motors in which switching of the speed of rotation takes place by selective "neutralization" and activation of selected motor working chambers or working chamber groups, while maintaining the functional principle of switching speeds without jerky movements. In this way, not only multi-stroke axial or radial piston motors, but also hydraulic motors according to the planetary wheel principle, i.e. so-called gerotors, or also very different designs of piston motors with stepped pistons, the structure of which was described in very general terms in the introduction to the specification, can also be operated with the control circuit according to the invention.

The control circuit is not limited to a switch taking place merely between two speeds. Instead, the concept of the control circuit according to the invention can easily be used for hydraulic motors that have any number of speed levels.

The invention thereby creates a hydraulic control circuit for a hydraulic motor, particularly a radial piston motor having two speeds, with which switching from one speed to another takes place by changing the absorption volume, in that the intake side is short-circuited with the outlet side at a selected number of motor pistons, by means of a valve arrangement. In order to ensure, in particularly space-saving manner, that switching between the speeds takes place without jerky movements and thereby as gently as possible for the individual components, at least one intermediate switching position is provided for the valve arrangement, between the two end switching positions, in which the intake side is connected with the outlet side in throttled manner, i.e. via an orifice arrangement. Preferably, control of the valve arrangement takes place in such a way that a valve body can be moved through the intermediate switching position at a controlled speed.

What is claimed is:

1. Hydraulic control circuit for a hydraulic motor having at least two speeds, with which switching from one speed to another takes place by changing an absorption volume, comprising:

a valve arrangement configured to selectively neutralize absorption volumes of selected motor working chambers, wherein a related intake side for the selected motor working chambers is short-circuited with an outlet side, wherein the valve arrangement has at least one intermediate switching position between two switching positions assigned to the switching process, in each instance, in which the intake side is connected with the outlet side, with throttling of flow medium supply to the motor working chambers to be neutralized, by an orifice arrangement, wherein control of the valve arrangement takes place such that a valve body of the valve arrangement is configured to move through the intermediate switching position in a controlled manner, wherein the valve arrangement includes a first directional valve formed by an infinitely adjustable 4/2-way valve, which produces a connection between an intake of a motor working chamber with an absorption volume not to be neutralized and the intake of the motor working chamber with an absorption volume to be neutralized and between outlets of the motor working chambers, in each instance, in a one end switching position of the 4/2-way valve, and in another end switching position of the 4/2-way valve short-circuits the intake and outlet of the motor working chamber to be turned on and shut off and, at a same time, blocks a remainder of the connection, wherein a control pressure of a control pressure line downstream from an orifice is used to control the valve arrangement, wherein the orifice lies downstream from an inlet directional valve, with which the control pressure line can be connected either with a tank pressure or with an amplifier pressure, and wherein the orifice is configured to be circumvented by a sequential switching valve that switches to circumvent the orifice above a threshold value for the control pressure for the valve arrangement.

2. Hydraulic control circuit according to claim 1, for a radial piston motor having the at least two speeds, with which the switching from the one speed to another takes place by changing the absorption volume, wherein at a selected number of motor pistons, the intake side is short-circuited with the outlet side by the valve arrangement, wherein the valve arrangement connects the intake side with the outlet side, in the intermediate switching position, in which throttling of the flow medium supply to the motor pistons of the motor piston group to be neutralized with respect to an absorption volume of the group takes place, by the orifice arrangement.

3. Control circuit according to claim 1, wherein an initial pressure through the infinitely adjustable pressure valve is used to control the valve arrangement.

4. Control circuit according to claim 3, wherein the control pressure of the valve arrangement is configured to be changed ramp-like.

5. Control circuit according to claim 3, wherein the control pressure of the valve arrangement is configured to be changed progressively.

6. Control circuit according to claim 1, wherein the valve arrangement includes a second directional valve, with which, in an operational state in which the 4/2-way valve is in its other end switching position, flow medium can be supplied into shunted input and output ports (C, D).

7. Control circuit according to claim 1, wherein the valve bodies of the first directional valve and a second directional valve are arranged concentric to one another.

8. Control circuit according to claim 1, wherein the valve body of the infinitely adjustable 4/2-way valve includes a valve piston that has the control pressure applied to it, counter to a pressure spring, control edges of which piston are provided with grooves that form the orifice arrangement.

9. Radial piston motor with a control circuit according to claim 1, wherein the valve arrangement is integrated into the motor housing.

10. Radial piston motor according to claim 9, wherein the valve arrangement is structured as an insertion module.

11. Hydraulic control circuit for a hydraulic motor having at least two speeds, with which switching from one speed to another takes place by changing an absorption volume, comprising:

a valve arrangement configured to selectively neutralize absorption volumes of selected motor working chambers, wherein a related intake side for the selected motor working chambers is short-circuited with an outlet side, wherein the valve arrangement has at least one intermediate switching position between two switching positions assigned to the switching process, in each instance, in which the intake side is connected with the outlet side, with throttling of flow medium supply to the motor working chambers to be neutralized, by an orifice arrangement, and wherein control of the valve arrangement takes place such that a valve body of the valve arrangement is configured to move through the intermediate switching position in a controlled manner, wherein the valve arrangement includes a first directional valve formed by an infinitely adjustable 4/2-way valve, which produces a connection between an intake of a motor working chamber with an absorption volume not to be neutralized and the intake of the motor working chamber with an absorption volume to be neutralized and between outlets of the motor working chambers, in each instance, in a one end switching position of the 4/2-way valve, and in another end switching position of the 4/2-way valve short-circuits the intake and outlet of the motor working chamber to be turned on and shut off and, at a same time, blocks a remainder of the connection, wherein the valve arrangement includes a second directional valve, with which, in an operational state in which the 4/2-way valve is in its other end switching position, flow medium can be supplied into shunted input and output ports (C, D), wherein the second directional valve includes an infinitely adjustable 3/2-way valve that feeds a control pressure into a supply circuit for the neutralized motor working chamber.

12. Hydraulic control circuit for a hydraulic motor having at least two speeds, with which switching from one speed to another takes place by changing an absorption volume, comprising:

a valve arrangement configured to selectively neutralize absorption volumes of selected motor working chambers, wherein a related intake side for the selected motor working chambers is short-circuited with an outlet side, wherein the valve arrangement has at least one intermediate switching position between two switching positions assigned to the switching process, in each instance, in which the intake side is connected with the outlet side, with throttling of flow medium supply to the motor working chambers to be neutralized, by an orifice arrangement, and wherein control of the valve arrangement takes place such that a valve body of the valve arrangement is configured to move through the intermediate switching position in a controlled manner, wherein the valve arrangement includes a first directional valve formed by an infinitely adjustable 4/2-way valve, which produces a connection between an intake of a motor working chamber with an absorption volume not to be neutralized and the intake of the motor working chamber with an absorption volume to be neutralized and between outlets of the motor working chambers, in each instance, in a one end switching position of the 4/2-way valve, and in another end switching position of the 4/2-way valve short-circuits the intake and outlet of the motor working chamber to be turned on and shut off and, at a same time, blocks a remainder of the connection, wherein the valve arrangement includes a second directional valve, with which in an operational state in which the 4/2-way valve is in its other end switching position, flow medium can be supplied into shunted input and output ports (C, D), wherein the second directional valve includes a 2/2 switching valve that feeds system pressure into a supply circuit of the shut-off motor working chamber.

13. Hydraulic control circuit for a hydraulic motor having at least two speeds, with which switching from one speed to another takes place by changing an absorption volume, comprising:

a valve arrangement configured to selectively neutralize absorption volumes of selected motor working chambers, wherein a related intake side for the selected motor working chambers is short-circuited with an outlet side, wherein the valve arrangement has at least one intermediate switching position between two switching positions assigned to the switching process, in each instance, in which the intake side is connected with the outlet side, with throttling of flow medium supply to the motor working chambers to be neutralized, by an orifice arrangement, wherein control of the valve arrangement takes place such that a valve body of the valve arrangement is configured to move through the intermediate switching position in a controlled manner, wherein the valve arrangement includes a first directional valve formed by an infinitely adjustable 4/2-way valve, which produces a connection between an intake of a motor working chamber with an absorption volume not to be neutralized and the intake of the motor working chamber with an absorption volume to be neutralized and between outlets of the motor working chambers, in each instance, in a one end switching position of the 4/2-way valve, and in another end switching position of the 4/2-way valve short-circuits the intake and outlet of the motor working chamber to be turned on and shut off and, at a same time, blocks a remainder of the connection, wherein the valve arrangement includes a second directional valve, with which, in an operational state in which the 4/2-way valve is in its other end switching position, flow medium ca be supplied into shunted input and output ports (C, D), wherein the second directional valve includes control pressure of the infinitely adjustable 4/2-way valve applied to it and is controlled by it.

* * * * *